US006235460B1

(12) United States Patent
Takada et al.

(10) Patent No.: US 6,235,460 B1
(45) Date of Patent: May 22, 2001

(54) SILVER HALIDE EMULSION AND SILVER HALIDE PHOTOGRAPHIC LIGHT SENSITIVE MATERIAL

(75) Inventors: Hiroshi Takada; Shigetami Kasai; Toshiya Kondo, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/549,652

(22) Filed: Apr. 14, 2000

(30) Foreign Application Priority Data

Apr. 19, 1999 (JP) ..... 11-110798

(51) Int. Cl.[7] ..... G03C 1/035
(52) U.S. Cl. ..... 430/567
(58) Field of Search ..... 430/567

(56) References Cited

U.S. PATENT DOCUMENTS 5,518,873 * 5/1996 Konishi et al. ..... 430/567
5,550,015 * 8/1996 Karthauser ..... 430/569
5,780,216 * 7/1998 Ihama ..... 430/567

FOREIGN PATENT DOCUMENTS

0202784 * 9/1991 (EP) .

* cited by examiner

*Primary Examiner*—Hoa Van Le
(74) *Attorney, Agent, or Firm*—Jordan B. Bierman; Bierman, Muserlian and Lucas

(57) ABSTRACT

A silver halide emulsion is disclosed, comprising silver halide grains and a dispersing medium, wherein the silver halide grains, each comprises a first high-iodide phase and a second high-iodide phase, each of the first and second high-iodide phases accounting for 0.5 to 5% of the grain, based on silver, and each of the first and second high-iodide phases having an iodide content of more than 40 mol %. A silver halide photographic material containing the emulsion is also disclosed.

20 Claims, No Drawings

SILVER HALIDE EMULSION AND SILVER HALIDE PHOTOGRAPHIC LIGHT SENSITIVE MATERIAL

FIELD OF THE INVENTION

The present invention relates to silver halide emulsions and silver halide photographic light sensitive materials and in particular to silver halide emulsions superior in sensitivity, graininess, pressure resistance and image sharpness and to silver halide photographic light sensitive materials by use thereof.

BACKGROUND OF THE INVENTION

To achieve improvements in basic photographic characteristics such as photographic speed, graininess and pressure resistance of silver halide emulsions and silver halide photographic light sensitive materials, there have been made attempts to provide silver halide grains characterized in halide composition, specifically, iodide distribution within the grain.

U.S. Pat. No. 4,668,614 discloses a technique of double structure grains comprising a high iodide core and a low iodide shell, thereby enhancing sensitivity and graininess. U.S. Pat. No. 4,614,711 discloses a technique of triple structure grains comprising a low iodide core, a high iodide intermediate shell and a low iodide shell, whereby sensitivity, graininess and pressure resistance are enhanced. European Patent 202784B discloses a technique of quadruple structure grains, in which between a high iodide inner shell and a low iodide outer shell, an intermediate shell having an intermediate iodide content is further provided between the iodide contents of inner and outer shells, thereby enhancing the sensitivity/fog ratio and graininess. JP-A 7-244345 (herein the term, JP-A refers to an unexamined and published Japanese Patent Application) discloses a technique of silver halide grains comprising an internal core containing 1 mol % or less iodide, a first covering layer containing 2 to 20 mol % iodide, a second covering layer containing 3 mol % or less iodide and a high iodide phase formed during and after formation of the second covering layer, thereby enhancing pressure resistance, sensitivity, latent image stability and incubation resistance. JP-A 8-314040 and 9-197593 and U.S. Pat. No. 5,728,515 also disclose similar techniques. However, still further enhanced sensitivity, graininess and pressure resistance are desired. Furthermore, these techniques produced problems such as deteriorated sharpness, so that a technique for solving such problems is desired.

SUMMARY OF THE INVENTION

Accordingly, an object of the present invention is to enhance sensitivity, graininess and pressure resistance as well as sharpness, thereby providing silver halide emulsions superior in such characteristics and silver halide photographic light sensitive materials by use thereof.

The object of the invention can be accomplished by the following constitution:

(1) A silver halide emulsion comprising silver halide grains and a dispersing medium, wherein each of the silver halide grains comprises a first high-iodide phase and a second high-iodide phase, said first and second high-iodide phases each accounting for 0.5 to 5% of the grain, based silver, and said first and second high-iodide phases each having an iodide content of more than 40 mol %;

(2) The silver halide emulsion described in (1), wherein the grain further comprises an intermediate phase located between the first high-iodide phase and the second high-iodide phase, said intermediate phase having an average iodide content of 0 to 10 mol %;

(3) The silver halide emulsion of (2), wherein the intermediate phase has an iodide content of 0 to 10 mol %;

(4) The silver halide emulsion of (3), wherein at least one of the first and second high-iodide phases accounts for 1 to 4% of the grain in terms of silver amount;

(5) The silver halide emulsion of (3), wherein the intermediate phase accounts for 15 to 50% of the grain, based on silver;

(6) The silver halide emulsion of (3), wherein the grain further comprises an internal phase located inside the first and second high-iodide phases, the internal phase accounting for 5 to 60% of the grain, based on silver, and having an average iodide content of 0 to 10 mol %;

(7) The silver halide emulsion of (6), wherein the internal phase has an iodide content of 0 to 10 mol %;

(8) The silver halide emulsion of (7), wherein the grain further comprises a shell phase located outside the first and second high-iodide phases, the shell phase occupying 10 to 50% of the grain, based on silver;

(9) A silver halide emulsion comprising silver halide grains and a dispersing medium, wherein each of the silver halide grains comprises, from inside to outside of the grain, an internal phase accounting for 5 to 60% of the grain, based on silver, and having an average iodide content of 0 to 10 mol %, a first high-iodide phase occupying 0.5 to 5.0% of the grain, based on silver, and having an average iodide content of more than 40 mol %, an intermediate phase accounting for 10 to 70% of the grain, based on silver, and having an average iodide content of 0 to 10 mol %, a second high-iodide phase occupying 0.5 to 5% of the grain, based on silver, and having an average iodide content of more than 40 mol %, and a shell phase occupying 10 to 50% of the grain, based on silver, and having an average iodide content of 0 to 10 mol %;

(10) The silver halide emulsion of (9), wherein at least one of the first and second high-iodide phases accounts for 1 to 4% of the grain, based on silver;

(11) The silver halide emulsion of (10), wherein the intermediate phase accounts for 15 to 50% of the grain, based on silver;

(12) The silver halide emulsion of (11), wherein the shell phase accounts for 20 to 40% of the grain, based on silver and has an average iodide content of 0 to 6 mol %;

(13) The silver halide emulsion of (12), wherein the internal phase has an average iodide content of 0 to 3 mol %;

(14) A silver halide emulsion comprising silver halide grains and a dispersing medium, each of the silver halide grains comprising a high-iodide phase accounting for 1 to 3.5% of the grain, based on silver, and having an average iodide content of more than 40 mol %, wherein the grain further comprises dislocation lines located inside the high-iodide phase;

(15) The silver halide emulsion of (13), wherein the grain further comprises dislocation lines inside either of the first or second high-iodide phase;

(16) The silver halide emulsion of (15), wherein the grain comprises dislocation lines located inside and outside of either of the first or second high-iodide phase;

(17) The silver halide emulsion of (9), wherein at least 50% of total grain projected area is accounted for by tabular grains having an aspect ratio of at least 3;

(18) The silver halide emulsion of (9), wherein at least 50% of total grain projected area is accounted for by grains having at least 10 dislocation lines in the fringe portion;

(19) The silver halide emulsion of (9), wherein a variation coefficient of thickness of the grains in the emulsion is 25% or less;

(20) A silver halide emulsion comprising silver halide grains and a dispersing medium, wherein each of the silver halide grains comprises, from inside to outside of the grain, an internal phase accounting for 5 to 60% of the grain, based on silver, and having an iodide content of 0 to 10 mol %, a first high-iodide phase accounting for 0.5 to 5.0% of the grain, based on silver, and having an iodide content of more than 40 mol %, an intermediate phase accounting for 10 to 70% of the grain, based on silver, and having an iodide content of 0 to 10 mol %, a second high-iodide phase occupying 0.5 to 5% of the grain, based on silver, and having an iodide content of not less than 40 mol %, and a shell phase accounting for 10 to 50% of the grain, based on silver, and having an iodide content of 0 to 10 mol %;

(21) The silver halide emulsion of (20), wherein at least one of the first and second high-iodide phases accounts for 1 to 4% of the grain, based on silver;

(22) The silver halide emulsion of (21), wherein the intermediate phase accounts for 15 to 50% of the grain, based on silver;

(23) The silver halide emulsion of (22), wherein the shell phase occupies 20 to 40% of the grain, based on silver and has an iodide content of 0 to 6 mol %;

(24) The silver halide emulsion of (23), wherein the internal phase has an iodide content of 0 to 3 mol %;

(25) A silver halide emulsion comprising silver halide grains and a dispersing medium, each of the silver halide grains comprising a high-iodide phase accounting for 1 to 3.5% of the grain, based on silver, and having an iodide content of more than 40 mol %, wherein the grain further comprises dislocation lines located inside the high-iodide phase;

(26) The silver halide emulsion of (24), wherein the grain further comprises dislocation lines inside either of the first or second high-iodide phase;

(27) The silver halide emulsion of (26), wherein the grain comprises dislocation lines located inside and outside of either of the first or second high-iodide phase;

(28) A silver halide photographic light sensitive material comprising a silver halide emulsion containing silver halide grains and a dispersing medium, wherein each of the silver halide grains comprises, from inside to outside of the grain, an internal phase accounting for 5 to 60% of the grain, based on silver, and having an average iodide content of 0 to 10 mol %, a first high-iodide phase accounting for 0.5 to 5.0% of the grain, based on silver, and having an average iodide content of more than than 40 mol %, an intermediate phase accounting for 10 to 70% of the grain, based on silver, and having an average iodide content of 0 to 10 mol %, a second high-iodide phase accounting for 0.5 to 5% of the grain, based on silver, and having an average iodide content of not less than 40 mol %, and a shell phase accounting for 10 to 50% of the grain, based on silver, and having an average iodide content of 0 to 10 mol %; and

(29) A silver halide photographic light sensitive material comprising a silver halide emulsion containing silver halide grains and a dispersing medium, wherein each of the silver halide grains comprises, from inside to outside of the grain, an internal phase accounting for 5 to 60% of the grain, based on silver, and having an iodide content of 0 to 10 mol %, a first high-iodide phase accounting for 0.5 to 5.0% of the grain, based on silver, and having an iodide content of more than 40 mol %, an intermediate phase accounting for 10 to 70% of the grain, based on silver, and having an iodide content of 0 to 10 mol %, a second high-iodide phase accounting for 0.5 to 5% of the grain, based on silver, and having an iodide content of not less than 40 mol %, and a shell phase accounting for 10 to 50% of the grain, based on silver, and having an iodide content of 0 to 10 mol %.

DETAILED DESCRIPTION OF THE INVENTION

One feature of the invention concerns silver halide grains having at least two high iodide-localized phases across an intermediate phase. In the case of silver halide grains having at least two high iodide phases known in the prior art described above, the iodide content of the inner high iodide phase was not more than 40 mol %, and mostly 10 to 30 mol %. In the invention, at least two high iodide phases are formed separately in the interior and exterior regions of the grain, thereby solving the problems described above.

The present invention will be described in detail. Silver halide grains having the above-described feature contained in a silver halide emulsion relating to the invention are sometimes referred to as silver halide grains according to the invention.

A dispersing medium contained in silver halide emulsions used in the invention is referred to as a compound exhibiting a protective colloid property for silver halide grains or its solution. It is preferred that the dispersing medium be allowed to exist over an overall period of time from the nucleation stage to the grain growth stage in the course of grain formation. Preferred dispersing mediums used in the invention include gelatin and hydrophilic colloids. Examples of gelatin include alkali-processed gelatin or acid-processed gelatin having a molecular weight of ca. 100,000, oxidized gelatin and enzyme-treated gelatin described in Bull. Soc. Sci. Photo. Japan No. 16, page 30 (1966). It is preferred to employ gelatin having an average molecular weight of 10,000 to 70,000 (more preferably, 10,000 to 50,000) at the nucleation stage of silver halide grains. To reduce the average molecular weight of gelatin, the gelatin may be subjected to a degradation process using an enzyme or hydrogen peroxide. The use of gelatin with a reduced methionine content at the nucleation stage is also preferred. The methionine content is preferably not more than 50 $\mu$mol, and more preferably not more than 20 $\mu$mol per unit weight (g) of the dispersing medium. The methionine content in gelatin can be reduced by oxidizing gelatin with an oxidizing agent such as hydrogen peroxide.

Examples of hydrophilic colloids include gelatin derivatives, graft polymers of gelatin and other polymers, proteins such as albumin and casein, cellulose derivatives such as hydroxyethyl cellulose, carboxymethyl cellulose and cellulose sulfuric acid ester, sugar derivatives such as starch derivatives, and synthetic hydrophilic polymeric materials such as polyvinyl alcohol, polyvinyl alcohol partial acetal, poly-n-pyrrolidone, polyacrylic acid, polymethacrylic acid, polyacrylamide, polyvinyl imidazole, and polyvinyl pyrazole, including their copolymers. Besides alkali-processed gelatin are also usable acid-processed gelatin, enzyme-treated gelatin described in Bull. Soc. Sci. Photo. Japan No. 16, page 30 (1966) and gelatin hydrolysates or gelatin zymolytic products.

Silver halide grains contained in a photographic silver halide emulsion are microcrystals comprised of silver chloride, silver bromide, silver iodide or their solid solution. Halide composition of silver halide grains used in the invention may be any one of silver iodobromide, silver iodochlorobromide, and silver iodochloride. Of these is preferred silver iodobromide or silver iodochlorobromide having an average iodide content of 1 to 20 mol %. Other silver salts, such as silver rhodanate, silver sulfide, silver selenide, silver carbonate, silver phosphate, an organic acid silver salt may be contained as a separate grain or as a part of a silver halide grain. When desired to shorten the process of developing and desilvering (such as bleaching, fixing and bleach-fixing), the average iodide content is lessened or chloride is contained. The iodide content may be increased to optimally retard development.

In the invention, the expression "a phase having a prescribed iodide content" means that the phase contains the prescribed iodide at any segment within the phase. Further, the expression "a phase having a prescribed average iodide content" means that the phase exhibits the prescribed average value of the overall iodide content of the phase.

In the invention, the high iodide phase contained in a silver halide grain is a silver halide phase having an extremely high iodide content, accounting for a small proportion within the grain and being localized in the interior of the grain. Thus, the high iodide phase has an average iodide content of more than 40 mol % and not more than 100 mol %, forming 0.5 to 5% of the grain, based on total silver forming the grain. The average iodide content of the high iodide phase is preferably 95 to 100 mol % and the proportion of the high iodide phase preferably being 1 to 3.5% of the grain, based on silver forming the grain. The high iodide phase can be formed by adding an aqueous silver salt solution and an aqueous halide solution containing at least 40 mol % of an iodide salt by double jet addition or by adding an aqueous silver salt solution and an aqueous iodide solution by double jet addition. The proportion accounted for by the thus formed high iodide phase can be determined from the amount of silver added during grain formation. The high iodide phase can also be formed by adding an aqueous iodide solution by single jet addition or by the use of an iodide-releasing agent. In this case, assuming that halide conversion to iodide takes place to the extent of 100%, the proportion of the high iodide phase, based on silver, can be determined as an amount of silver equimolar to the added iodide, and the iodide content of the thus formed high iodide phase is defined to be 100 mol %. Further, the high iodide phase can also be formed by adding a silver iodide emulsion containing fine silver iodide grains. In this case, the proportion of the thus formed high iodide phase can be determined from the silver amount of the silver iodide emulsion and the iodide content thereof is defined to be 100 mol %. The silver iodide fine grain emulsion can be prepared, for example, according to the method described in U.S. Pat. No. 4,672,026. The average size of fine silver iodide grains is preferably not more than 0.06 $\mu$m, and more preferably not more than 0.03 $\mu$m, in terms of sphere-equivalent diameter. Of the methods described above, double jet addition of an aqueous silver salt solution and an aqueous iodide solution, the addition of a silver iodide fine grain emulsion and the addition of an iodide-releasing agent are preferred to form the high iodide phase.

Silver halide grains according to the invention internally include an intermediate phase between at least two high iodide phases. In cases where three or more high iodide phases are included in the grain, the silver halide grains each include an intermediate phase between at least any two high iodide phases. The intermediate phase may have a homogeneous halide composition, or be comprised of plural silver halide phases different in halide composition or of a silver halide phase in which the iodide content is continuously varied. The intermediate phase preferably has an average iodide content of 0 to 10 mol %, and forming preferably 10 to 70% of the grain, based on total silver forming the grain. The average iodide content of the intermediate phase is more preferably 0 to 5 mol % and the proportion of the intermediate phase more preferably accounts for 15 to 50% of the grain, based on silver.

The silver halide grains each include a shell phase located outside the outermost high iodide phase among the high iodide phases. The shell phase may have a homogeneous halide composition, or be comprised of plural silver halide phases different in halide composition or of a silver halide phase in which the iodide content is continuously varied. The shell phase preferably has an average iodide content of 0 to 10 mol %, and forming preferably 10 to 50% of the grain, based on total silver forming the grain. The average iodide content of the shell phase is more preferably 0 to 6 mol % and the proportion of the shell phase more preferably accounts for 20 to 40% of the grain, based on silver forming the grain.

The silver halide grains-according to the invention each further include an internal phase located inside the innermost high iodide phase among the high iodide phases. In cases where the silver halide emulsion used in the invention is formed by allowing pre-formed silver halide nucleus grains or silver halide seed grains to be grown, the nucleus grain or seed grain may be included in the internal phase. Alternatively, a silver halide phase different in composition from the nucleus grains or seed grains may be allowed to grow to form the internal phase. The internal phase may have a homogeneous halide composition, or be comprised of plural silver halide phases different in halide composition, or of a silver halide phase in which the iodide content is continuously varied. The internal phase preferably has an average iodide content of not more than 10 mol %, and forming preferably 5 to 60% of the grain, based on total silver forming the grain. The average iodide content of the intermediate phase is more preferably 0 to 3 mol %.

The intermediate phase, shell phase and internal phase can be formed by commonly known methods for preparing silver halide emulsions. Silver halide emulsions used in the invention can be prepared by referring to the methods described in P. Glafkides, Chimie et Physique Photographique (Paul Montel, 1967); C. F. Duffin, Photographic Emulsion Chemistry (Focal Press, 1966); and V. L. Zelikman et al., Making and Coating Photographic Emulsion (Focal Press, 1964). Thus, any of acidic precipitation, neutral precipitation and ammoniacal precipitation can be employed. As a reaction mode of aqueous silver salt and halide solutions during grain formation is employed any one of a single jet addition, double jet addition and a combination thereof. There may be employed a method of forming silver halide grains in the presence of silver ions in excess, so-called reverse precipitation. As one mode of the double jet addition to control the pAg in a liquid phase forming silver halide is known a controlled double jet method, which is effective to enhance homogeneity in grains during the growth process of silver halide grains and which is preferably employed to form the intermediate phase, shell phase and internal phase described above.

There may be employed a method of adding pre-formed silver halide grains to a reaction vessel used for emulsion preparation, as described in U.S. Pat. Nos. 4,334,012, 4,301,241 and 4,150,994. Specifically, addition as a supplying source of silver and halide ions to be used for grain growth is a preferred embodiment. The addition method is optionally selected from addition of the total amount at a time, plural-separated addition and continuous addition. Addition of grains having different halide composition is also effective to modify the surface of silver halide grains used in the invention.

Besides a method of adding aqueous silver salt and halide solutions at a constant concentration or at a constant flow rate, addition with varying the concentration or the flow rate is also preferred, as described in British Patent 1,469,480 and U.S. Pat. Nos. 3,650,757 and 4,242,445. Increasing the concentration or increasing the flow rate can be achieved by varying the addition of silver salt and halide salt solutions according to a linear function, a quadratic function or complex function of addition time. A mixing mechanism of the reaction vessel is selected, for example, from the methods described in U.S. Pat. Nos. 2,996,287, 3,342,605, 3,415,650, and 3,785,777; and West German Patent 2,556,885 and 2,555,64.

Silver halide solvents are usable for the purpose of accelerating ripening. As is well known, for example, an excess amount of a halide ion is allowed to be present in the reaction vessel to accelerate ripening. Other ripening-accelerating agents such as silver halide solvents may be employed. The ripening-accelerating agent (or ripening agent) may be incorporated into a dispersing medium prior to addition of an aqueous silver salt or halide solution, or introduced into the reaction vessel, together with an aqueous silver salt or halide salt solution or the dispersing medium. Alternatively, the ripening agent may be introduced independently from the addition of aqueous silver salt or halide solution. Examples of silver halide solvents include ammonia, thiocyanates (e.g., potassium rhodate, potassium rhodate), organic thioether compounds (e.g., compounds described in U.S. Pat. Nos. 3,574,628, 3,021,215, 3,057,724, 3,038,805, 4,276,374, 4,297,439, 3,704,130, 4,782,013 and JP-A 57-104926), thione compounds (e.g., tetra-substituted thiourea compounds described in JP-A 53-82408, 55-77737, and U.S. Pat. No. 4,782,013; and compounds described in JP-A 53-144319), mercapto compounds capable of promoting silver halide grain growth, described in JP-A 57-202531, and amine compounds (e.g., compounds described in JP-A 54-100717).

It is preferred that silver halide emulsions used in the invention be subjected to washing to remove soluble salts and then dispersed in an aqueous solution containing a dispersing medium. The washing temperature is optional and preferably 5 to 60° C. The pH at the washing is preferably 2 to 10, and more preferably 3 to 8. The pAg is optional and preferably 5 to 10. Examples of the washing method include noodle washing, dialysis using a semipermeable membrane, centrifugation, coagulation (or flocculation) process and ion exchange. The coagulation process includes, for example, a method of using sulfates, a method of using organic solvents, a method of using aqueous soluble polymers, and a method of using modified gelatin or denatured gelatin. In the preparation of silver halide emulsions used in the invention, a desalting method described in JP-A 5-72658 is preferably employed.

Another feature of silver halide grains relating to the invention concerns silver halide grains containing dislocation lines located inner-side at least a high iodide phase or silver halide grains containing dislocation lines located inner-side and outer-side of the high iodide phase. The dislocation lines are preferably 10 or more, and more preferably 20 or more per grain. The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are placed on a mesh for electron microscopy. The sample is observed by transmission electron microscopy, while being cooled to prevent the grain from being damaged (e.g., printing-out) by electron beam. Since electron beam penetration is hampered as the grain thickness increases, sharper observations are obtained when using an electron microscope of high voltage type. From the thus-obtained electron micrograph can be determined the position and number of the dislocation lines in each grain. In cases when the dislocation lines are closely exist, it is often hard to accurately count the number of dislocation lines per grain. Even in such cases, however, it is possible to judge whether the dislocation lines are at least 10 lines or not, or at least 20 lines or not. The presence of a few lines can be precisely discriminated. The average number of dislocation lines per grain can be obtained as an arithmetic average value of at least 100 grains. Introduction of the dislocation lines can be achieved by forming a low iodide phase adjacent to a high iodide phase. When forming an intermediate phase adjacent to the inner high iodide phase or a shell phase adjacent to the outer high iodide phase, for example, the dislocation lines can be introduced into the intermediate phase or the shell phase by suitable selection of a method of forming the high iodide phase, the proportion accounted for by the high iodide phase within the grain, the iodide content of the intermediate phase or shell phase and various conditions during grain formation such as a pAg. The number or form of the dislocation lines can be varied by suitable selection of various conditions described above. In cases where silver halide grains are tabular grains, for example, dislocation lines of 10 or more per grain can be introduced into the fringe (or peripheral portion) of the tabular grains by making the proportion of the outer high iodide phase about 2% of the grain, based on silver and forming the shell phase under the condition of a low pBr.

Herein, the term, fringe means the portion including the periphery and the vicinity thereof, corners and the vicinity thereof, and edges and the vicinity thereof of the tabular grain. Concretely, when the tabular grain is viewed vertically to the major face and the length of a line connecting the center of the major face (or the center of gravity when the major face is supposed to be a two-dimensional plane, its center of gravity) and each corner is defined as L, the fringe is a region outside of a polygonal region connecting points at a distance from the center of 0.7 L on each of the lines.

The shape of silver halide grains include regular crystal forms such as cubic, octahedral or tetradecahedral grains, irregular crystal forms such as tabular grains and potato-like grains, grains including crystal defects such as a twinned plane and composite grains thereof. In the silver halide emulsion used in the invention, at least 50% of the total grain projected area is preferably accounted for by tabular grains having an aspect ration of 3 or more. More preferably, at least 50% of the total grain projected area is accounted for by tabular grains having an aspect ration of 5 or more, and still more preferably, at least 80% of the total grain projected area is preferably accounted for by tabular grains having an aspect ration of 5 or more. The tabular silver halide grains are crystallographically classified into a twinned crystal. The twinned crystal is a crystal including at least a twinned plane within the crystal grain. Classification of the twinned crystal in silver halide grains are detailed in Klein & Moisar, Photographishe Korrespondenz, vol.99, page 99 and ibid vol.100, page 57. Tabular silver halide grains can be prepared with reference to Cleve, "Photography Theory and Practice" (1930), page 131; Gutoff, Photographic Science and Engineering, vol. 14, page 248–257 (19709; U.S. Pat. Nos. 4,434,226, 4,414,310, 4,433,048, 4,439,520; and British Patent 2,112,157.

Tabular silver halide grains relating to the invention include triangular, hexagonal circular forms. One of preferred embodiments of tabular silver halide grains is tabular grains having a substantially equilateral hexagonal form, as described in U.S. Pat. No. 4,797,354. The tabular silver halide grains relating to the invention preferably include one or two parallel twin planes within the grain. The twin plane exists parallel to the face having the maximum area among faces constituting the tabular grain surface (also referred to as a major face). Tabular grains having two twin planes are more preferred in the invention. The twin plane can be observed by means of a transmission electron microscope in the following manner. A sample is prepared by coating a silver halide tabular grain emulsion on a substrate so that the major faces of the tabular grains are oriented parallel to the substrate. The sample is continuously sliced vertically to the substrate to form about 0.1 $\mu$m thick slices. The thus obtained slice is observed by a transmission type electron microscope to confirm the presence of twin planes and their position.

The aspect ratio refers to a ratio of grain diameter to grain thickness. The grain diameter means a diameter of a circle having an equivalent area to a grain projected area when the grain is projected vertically to the major face. Thus, aspect ratio=diameter/thickness. The diameter of tabular grains is preferably 0.6 $\mu$m or less in terms of image quality, as described in U.S. Pat. No. 4,748,106; and the grain thickness thereof is preferably 0.3 $\mu$m or less, and more preferably 0.2 $\mu$m or less in terms of sharpness. To determine the grain diameter, grain thickness and aspect ratio, the projected area and thickness of each grain can be measured in the following manner. A coat sample is prepared by coating a silver halide emulsion containing latex balls, as an internal standard, having a given diameter on the substrate so that the major faces of the grains are oriented parallel to the substrate. After subjecting the sample to shadowing from a given angle by carbon vacuum evaporation, a replica sample is prepared by the conventional replica method. Electronmicrographs of the thus prepared sample are taken and the projected area and thickness of each grain can be determined using an image processing apparatus. In this case, the grain projected area can be determined from the projected area of the internal standard, and the grain thickness can also be determined shadow lengths of the internal standard and the grain.

Silver halide emulsions used in the invention are preferably those exhibiting little fluctuation in grain size. Concretely, a coefficient of variation (or variation coefficient) of grain size is preferably not more than 20%, and more preferably not more than 15%. The variation coefficient is defined as below and can be determined using measured values of the diameter of at least 300 grains contained in the emulsion:

Variation coefficient of grain diameter (%)=(standard deviation of grain diameter)/(average grain diameter)×100.

U.S. Pat. No. 4,797,354 and JP-A 2-838 disclose a preparation method of hexagonal tabular grains having a high tabularity. European Patent 514,742 describes a method of preparing tabular grains exhibiting a variation coefficient of grain size distribution of less than 10%, using polyalkyleneoxide copolymer. These techniques may be applied to the silver halide emulsions used in the invention.

The silver halide emulsion according to the invention enables to improve sharpness of photographic materials. In the prior art described above, silver halide grains include a core containing 10 to 30 mol % iodide and accounting for 10 to 70% of the grain, based on silver, which results in an increase in grain thickness or increased fluctuation in thickness, causing deterioration in sharpness. In the invention, on the other hand, making the core a high iodide phase having an average iodide content of 40 to 100 mol % lessens the proportion accounted for by the core within the grain, leading to improved sharpness. Concretely, it is possible to bring a variation coefficient of tabular grain thickness to 30% or less. In tabular silver halide grains used in the invention, the variation coefficient of grain thickness is preferably not more than 25%. The variation coefficient of grain thickness is defined as below and can be determined using measured values of the thickness of at least 300 grains contained in the emulsion:

Variation coefficient of grain thickness (%)=(standard deviation of grain thickness)/(average grain thickness)×100.

Techniques known as means for improving performance of silver halide emulsions are applicable to the silver halide emulsions relating to the invention. The silver halide emulsion, for example, may be subjected to reduction sensitization. Reduction sensitization nuclei may be formed on the silver halide grain surface or formed during grain growth. To provide the reduction nuclei to silver halide grains are known a method of adding a reducing agent (hereinafter, also referred to as a reduction sensitizer) to a silver halide emulsion or to a solution to be used for grain growth, and a method of ripening a silver halide emulsion under the environment of a low pAg of not more than 7 or a high pH of not less than 7, or undergoing grain formation under the same environment. Of these, addition of a reducing agent, which can be achieved without exerting any influence on growth of silver halide grains, is preferred to optimally undergo reduction sensitization. Preferred examples of reduction sensitizers include sttanous salts, amines and polyamines, hydrazine derivatives, formamidinesulfinic acid, silane compounds, and borane compounds. These reduction sensitizers may be used alone or in combination.

There is preferably employed a method, in which when intended formation of reduction sensitization nuclei is completed during formation of silver halide grains, a compound capable of oxidizing silver is added to oxidize post-formed reduction sensitization nuclei (silver nuclei). As an oxidizing/agent used for the purpose thereof is effective a compound a function of converting metallic silver to a silver ion. Such an oxidizing agent not only oxidizes unwanted reduction sensitization nuclei but also converts fine silver nuclei produced during grain formation or chemical sensitization to silver ions to effectively reduce fogging. The silver ion formed by the action of the oxidizing agent may further be converted to a scarcely water-soluble silver salt such as silver halide, silver sulfide or silver selenide, or to a water soluble salt such as silver nitrate. Oxidizing agents usable in the invention include inorganic and organic compounds. Preferred examples thereof include inorganic oxidizing agents such as ozone, hydrogen peroxide and its adducts, halogen elements, and thiosulfinates; and organic oxidizing agents such as quinines. Of these oxidizing agents is specifically preferred thiosulfinates.

Silver halide grains used in the invention may occlude a dopant. Photographically useful dopants such as polyvalent metal ions and their complex are generally employed. Silver halie grains may be doped during grain growth or during grain ripening. Alternatively, grain growth is interrupted and after being doped, the growth may further continue. Further, after completion of grain growth, doping may be conducted. As described in U.S. Pat. No. 3,772,031, chalcogen compounds may be added during formation of an emulsion. Besides S, Se and Te, cyanates, thiocyanates, selenocyanates, carbonates or acetates may be allowed to be present.

To silver halide emulsions relating to the invention may be-applied an epitaxial emulsion technique described in U.S. Pat. Nos. 4,435,501 and 4,471,050; JP-A 8-69069, 9-211762 and 9-211763. A method described in U.S. Pat. No. 4,435,501, for example, can be employed, in which a sensitizing dye is adsorbed onto the tabular grain surface to form an aggregation in such a state that silver halide epitaxy is directed to the edge or corner of the tabular grain. Cyanine dyes capable of adsorbing onto the surface of host tabular rains in a J-aggregate form are a preferred cite-director. It is also taught that using a non-dye-absorbing cite-director such as aminoazaindenes (e.g., adenine), epitaxy is allowed to be directed to the edge or corner of the tabular grain. However, preparation of the epitaxial emulsion is not specifically limited to these but other technique may be applicable. In cases when applying this epitaxial technique to silver halide emulsions relating to the invention, it is preferred to limit the silver halide epitaxy to less than 50 mol %, based on total silver. The extent of the silver halide epitaxy is more preferably 0.3 to 25 mol %, and optimally 0.5 to 15 mol % for sensitization. Epitaxy to a specifically limited portion on the silver halide grain surface is more efficient than epitaxy covering the overall surface. In the case of a host grains being a tabular silver halide grain, for example is preferred epitaxy substantially limited to the corner of the host tabular grain, and of which coverage on the major faces is also limited. Further, epitaxy limited to the corner or its vicinity, or limited to separated cites is more efficient.

In the invention is preferred a silver halide emulsion exhibiting less fluctuation in iodide content among grains. Concretely, a coefficient of variation of iodide content among silver halide grains is preferably not more than 20%, and more preferably not more than 15%. The coefficient of variation is a value of a standard deviation of iodide contents of grains, which can be determined by measuring the iodide content of each grain, divided by an average iodide content of the grains times 100(%). In this case, at least 500 grains selected at random from the emulsion are measured. Silver halide emulsions may be prepared in relation of the grain size with halide composition of the grain. For example, there may be provided such a relationship that the higher iodide content the larger grain and the lower iodide content the smaller grain. According to the object, reverse relationship or another relationship in halide composition may be selected. To achieve the object, for example, at least two emulsions different in composition may be blended.

Silver halide emulsion used in the invention may be subjected to chalcogen sensitization such as sulfur sensitization or noble metal sensitization such as gold sensitization at any time during the course of preparation of silver halide emulsions. These sensitization methods may be employed alone or in combination. Various types of emulsions can be prepared Depending on the stage at which chemical sensitization is applied, there are prepared various types of emulsions, including an emulsion in which chemical sensitization center is formed deeper in the interior of the grain, an emulsion in which chemical sensitization center is formed shallower from the grain surface and an emulsion in which chemical sensitization center is formed on the grain surface. The location of the chemical sensitization center can be selected according to the object and chemical sensitization center is preferably formed in the vicinity of the grain surface. Chemical sensitization applicable to silver halide emulsion used in the invention is sensitization by the use of chalcogen compounds and sensitization by the use of noble metals, which are employed alone or in combination, including, for example, the use of an active gelatin, as described in T. H. James, The Theory of the Photographic Process, 4th ed., pages 67–76 (Macmillan, 1977); and the use of sensitizers such as sulfur, selenium, tellurium, gold, platinum and palladium at a pAg of 5 to 10, a pH of 5 to 8, and a temperature of 30 to 80° C., as described in Research Disclosure vol.120, item 12008 (April, 1974); Research Disclosure vol.34, item 13452 (June, 1975); U.S. Pat. Nos. 2,642,361, 3,297,446, 3,773,031, 3,857,711, 3,901,714, 4,226,018, 3,904,415; and British patent 1,315755.

In noble metal sensitization are employed noble metal salts such as gold, -platinum, and palladium, and gold sensitization and palladium sensitization or the combination thereof are preferred. In gold sensitization are employed commonly known compounds such as chloroauric acid, potassium chloroaurate, potassium aurothiocyanate, gold sulfide, and gold selenide. Palladium compounds mean divalent or tetravalent palladium salt compounds and are preferably compounds represented by general formulas, $M_2PdX_6$ and $M_2PdX_4$, in which M is a hydrogen atom, an alkali metal or ammonium; and X is a halogen atom such as chlorine, bromine, or iodine. Preferred examples thereof include $K_2PdCl_4$, $(NH_4)_2PdCl_6$, $Na_2PdCl_4$, $(NH_4)_2PdCl_4$, $Li_2PdCl_4$, $Na_2PdCl_6$, $K_2PdBr_4$. Gold compounds or palladium compounds are preferably used in combination with thiocyanates or selenocyanates. The amount of a gold sensitizer is preferably $1\times10^{-7}$ to $1\times10^{-4}$, and more preferably $5\times10^{-7}$ to $1\times10^{-4}$ mol per mol of silver halide. The amount of a palladium sensitizer is preferably $5\times10^{-7}$ to $1\times10^{-3}$ mol per mol of silver halide. The amount of a thiocyanate or selenocyanate $1\times10^{-6}$ to $5\times10^{-2}$ mol per mol of silver halide.

One of chalcogen sensitization methods applicable to silver halide emulsion used in the invention is sulfur sensitization, in which hypo, thiourea compounds, rhodanine compounds and sulfur compounds described in U.S. Pat. Nos. 3,857,711, 4,226,018 and 4,054,457. Chemical sensitization may be conducted in the presence of an auxiliary agent for chemical sensitization. Examples of the auxiliary agent include azaindene, azapyridazine and azapyrimidine compounds, which inhibit fogging produced during chemical sensitization and enhance sensitivity. Auxiliary agents or modifiers for chemical sensitization are exemplarily described in U.S. Pat. Nos. 2,131,038, 3,411,914 and 3,554,757; JP-A 58-126526 and C. F. Duffin, Photographic Emulsion Chemistry, pages 138–143 (Focal Press, 1966). When silver halide emulsions used in the invention are subjected to sulfur sensitization, the amount of a sulfur sensitizer to be used is preferably $1\times10^{-7}$ to $1\times10^{-4}$ mol per mol of silver halide, and more preferably 5×1−7 to $1\times10^{-4}$ mol per mol of silver halide.

One of preferred chalcogen sensitization methods applicable to silver halide emulsions used in the invention is selenium sensitization, in which labile selenium compounds commonly known in the art are employed. Examples of such compounds include colloidal metallic selenium, selenoureas (e.g., N,N-dimethylselenourea, N,N-diethylselenourea), selenoketones and selenoamides. Selenium sensitization is preferably employed in combination ith sulfur sensitization or noble metal sensitization.

In general, various compounds may be incorporated into silver halide emulsions to inhibit fogging produced during preparation storage or processing of photographic materials, leading to stable photographic performance. Such compounds are known as an antifoggant or stabilizer and examples thereof include thiazoles such as benzthiazolium salts, nitroimidazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles, mercaptotetrazoles (specifically, such as 1-phenyl-5-mercaptotetrazole), mercaptipyrimidines, mercaptotriazines, thioketo compounds such as oxazolinethione, azaindenes such as triazaindenes tetraazaindenes (specifically, such as 4-hydroxy-1,3,3a,7-tetrazaindene) and pentazaindenes, as described in U.S. Pat. Nos. 3,954,474 and 3,982,947 and JP-B 52-28660. Specifically, compounds described in JP-A 63-212932 are preferred. These antifoggants or stabilizers may be optionally added before, during after grain formation, at the stage of washing, at the stage of dispersion after washing, before, during or after chemical sensitization, or before coating. In addition to antifogging or stabilizing effects, these compounds can also be employed for the purpose of controlling crystal habit during grain growth, restraining grain growth, or reducing grain solubility.

Spectral sensitizing dyes may be incorporated into silver halide emulsions used in the invention. In one preferred embodiment of the invention, a sensitizing dye is allowed to be adsorbed onto silver halide grains relating to the invention. Spectral sensitizing dyes include methine dyes, such as cyanine dyes, merocyanine dyes, complex cyanine dyes, complex merocyanine dyes, hopolar cyanine dyes, hemicyanine dyes, styryldyes and hemioxonol dyes. Of these, specifically useful dyes include cyanine dyes, merocyanine dyes and complex merocyanine dyes. These dyes contain basic heterocyclic nuclei. Examples thereof include pyroline nucleus, oxazoline nucleus, thiazoline nucleus, pyrrole nucleusoxazole nucleus, thiazole nucleus, imidazole nucleus, tetrazole nucleus, pyridine nucleus, their condensed rings with an alicyclic hydrocarbon ring and their condensed ring with an aromatic hydrocarbon ring, such as an indolenine nucleus, benzindolenine nucleus, indole nucleus, benzoxazole nucleus, naphthooxazole nucleus, benzoselenazole nucleus, benzimidazole v, and quinoline nucleus. These nuclei may be substituted on a carbon atom. In merocyanine or complex merocyanine dyes, a 5- or 6-membered ring having a ketomethylene structure may be applicable, such as pyrazoline-5-one nucleus, thiohydantoine nucleus, 2-thiooxazolidine-2,4-dione nucleus, thiazoline-2,4-dione V, rhodanine nucleus, and thiobarbituric acid nucleus.

Spectral sensitizing dyes are used alone or in combination. The combined use of sensitizing dyes are often employed for supersensitization. Exemplary examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707; British patent 1,344,281, 1,507,803; JP-B 43-4936, 53-12375; JP-A 52-110618 and 52-109925. A dye exhibiting no spectral sensitization ability or a substance exhibiting no visible absorption, each of which exhibit supersensitization may be incorporated into the emulsion together with a sensitizing dye. Sensitizing dyes are added to a silver halide emulsion, preferably after formation of silver halide grains. The sensitizing dye is usually added after chemical sensitization and before coating. The sensitizing dye may be added together with a chemical sensitizer to simultaneously perform chemical sensitization and spectral sensitization, as described in U.S. Pat. Nos. 3,628,969 and 4,225,666. The sensitizing dye may be added prior to chemical sensitization, as described in JP-A 58-113928. The sensitizing dye may be added before completion of silver halide grain formation to start spectral sensitization. As described in U.S. Pat. No. 4,255,66, the compound described above may be separately added, for example, a part of the compound is added priot to chemical sensitization (e.g., during silver halide grain formation, as described in U.S. Pat. No. 4,183,756) and the remainder thereof is added after chemical sensitization. The sensitizing dye is added preferably in an amount of $4\times10^{-6}$ to $8\times10^{-3}$ mol per mol of silver halide. Specifically, in cases where the silver halide grain size is 0.2 to 1.2 $\mu$m, the amount of the dye to be added is preferably $5\times10^{-5}$ to $2\times10^{-3}$ mol per mol of silver halide.

In cases when constituting a color photographic material using silver halide emulsions according to the invention are employed silver halide emulsions according to the invention, which have been subjected to physical ripening, chemical sensitization and spectral sensitization. Additives used in such process are described in Research Disclosure (hereinafter, also denoted as RD) 17643 page 23, sect. III to page 24, sect. III-M; Rd18716 pages 648–649; and RD308119, page 996, sect. III-A to page 1000, sect. VI-M. Photographic additives usable in the invention are also described in RD17643, page 25, sect. VIII-A to page 27, sect. XIII; RD18716, pages 650–651; RD308119, page 1003, sect. VIII-A to page 1012, sect. XXI-E. Various types of couplers can be employed in color photographic materials, and examples thereof are described in RD17643 page 15, sect. VII-C to -G; and RD308119, page 1001, sect. VII-C to -G. Additives used in the invention can be incorporated through dispersion in such a manner as described in RD308119, page 1007 sect. XIV. Supports described in RD17643, page 28, sect. XVII, RD18716, page 647–648; and RD308119, page 1009, sect. XVII. In the photographic material, an auxiliary layer such as a filter layer or interlayer may be provide, as described in RD308119, page 1002, sect. VII-K. Photographic materials can have various layer arrangements such as convention layer order, reverse order and unit constitution, as described in RD308119, VII-K.

Silver halide emulsions according to the invention can be applied to various color photographic materials, such as color negative films used for general purpose or cine films, color reversal films for reversal or television, color paper, color positive films, color reversal paper.

Photographic materials relating to the invention can be processed according to the manner as described in RD18716, page 651 and RD308119, page 1010 to 1011, sect. XIX.

In silver halide photographic materials relating to the invention are optionally employed silver halide emulsion other than silver halide emulsions according to the invention, including regular crystal grains having no twin plane, single twinned crystal grains, parallel multiple twinned crystal grains having two or more parallel twin planes and non-parallel multiple twinned crystal grains having two or more non-parallel twin planes. Further, two or more kind of grains different in crystal grain form may be blended, as described in U.S. Pat. No. 4,865,964. In the case of regular crystal grains can be employed cubic grains comprised of (100) faces, octahedral grains comprised of (111) faces or dodecahedral grains comprised of (110) faces described in JP-B 55-42737 and 60-222842. There are also optionally usable (hll) face grains such as (210) faces, (hhl) face grains such as (211) faces, (hk0) face grains such as (210) faces or (hkl) face grains such as (321) faces. Further, there are also employed grains having two or more kinds of faces, such as tetradecahedral grains having (100) and (111) faces, and grains having (100) and (110) faces.

Silver halide grains relating to the invention may be subjected to a treatment to round grains, as described in European Patent 96,727B1 and 64,412B1, or surface modification described in West German Patent 2,306,447 and JP-A 60-221320. Silver grains have, in general, an even surface structure but an uneven surface structure is sometimes intended. Examples thereof include grains bored in a part of the crystal such as corners or the center of the surface, as described in JP-A 58-106532 and 60-221320, and ruffle grains described in U.S. Pat. No. 4,643,966.

Besides silver halide emulsions according to the invention, polydisperse emulsions exhibiting a broad grain size distribution and monodisperse emulsions exhibiting a narrow grain size distribution may optionally be employed. A coefficient of variation of a projected area equivalent(or circular equivalent diameter) or sphere equivalent diameter is often used as the measure representing the grain size distribution. When a monodisperse emulsion is used, emulsions having a coefficient of variation of 20% or less (more preferably, 15% or less) are preferably used. To allow a photographic material to satisfy an intended gradation, two or more kinds of monodisperse emulsions having the same spectral sensitivity and different in grain size may be mixed in a single layer or multiply coated in separate layers. Further, at least two kinds of polydisperse emulsions, or monodisperse and polydisperse emulsions may be mixed or multiply coated.

In cases where silver halide emulsions according to the invention are employed in photographic materials, the additives described above are used. In addition thereto, various additives are employed, as described in RD17643 (December, 1978), RD18716 (November, 1979) and RD308119 (December, 1989).

As described above, the silver halide emulsion according to the invention can be applied to various photographic materials. As one of preferred embodiments, the silver halide emulsions of the invention are optimally used in multi-layered photographic materials having at least two silver halide emulsion layers. In the case of multi-layered photographic materials such as color negative films and color reversal films, for example, the silver halide emulsion of the invention may be used in any one of high-speed and low-speed layers.

EXAMPLES

Embodiments of the present invention will be explained based on examples, but the invention is not limited to these examples.

Example 1

Preparation of Emulsion A-01 (Comparative Example)

Formation of Internal Phase

An internal phase was formed in the following manner.

Nucleation stage:

A gelatin solution B-111 was maintained at 30° C. in a reaction vessel with stirring at a speed of 400 r.p.m. by use of a stirring mixer described in JP-A 62-160128, the pH was adjusted to 2 by adding 29.0 ml of a concentrated sulfuric acid solution diluted to 1/10. The pBr in the reaction vessel was 2.2, and thereto were added solutions S-111 and X-111 for 1 min. by the double jet addition to form nucleus grains. After completion of nucleation, solution G-111 maintained at 40° C. was further added thereto

| | | |
|---|---|---|
| B-111 | | |
| | Alkali-processed inert gelatin (Av. M.W. 100,000) | 12.1 g |
| | potassium bromide | 3.7 g |
| | $H_2O$ | 1293.8 g |
| S-111 | | |
| | Silver nitrate | 18.8 g |
| | $H_2O$ | 84.4 ml |
| X-111 | | |
| | potassium bromide | 13.2 g |
| | $H_2O$ | 83.9 ml |
| G-101 | | |
| | Alkali-processed inert gelatin (Av. M.W. 100,000) | 52.0 g |
| | Compound A (10 wt. % methanol solution) | 1.7 ml |
| | $H_2O$ | 1220 ml |

Compound A: $HO(CH_2CH_2O)_m[CH(CH_3)CH_2O]_{19.8}(CH_2CH_2O)_nH$ (m + n = 9.77)

After completing the addition, the temperature was raised to 60° C. in 30 min. and ripening was conducted for 30 min. Then adding 33.6 ml of 28% aqueous ammonia solution, the pH was adjusted to 9.3 with a 10% potassium hydroxide solution. During ripening, the silver potential of the reaction mixture was maintained at 6 mV (measured with a silver ion selection electrode versus a saturated silver-silver chloride electrode, as a reference electrode) using a 1N potassium bromide solution.

Growth stage:

After completing the ripening, the nucleus grains were grown to form an internal phase in the following manner.

3.5N aqueous silver nitrate solutions S-112 and 3.5N aqueous potassium bromide solution X-112 were added by the double jet addition at an accelerated flow rate (12 times faster at the end than at the start) for 38 min, while the silver potential was maintained at 6 mV with 1N potassium bromide solution. After completing the addition was added solution G-112.

| | | |
|---|---|---|
| S-112 | | |
| | Silver nitrate | 139.5 g |
| | $H_2O$ | 234.6 ml |

-continued

| | | |
|---|---|---|
| X-112 | | |
| | Potassium bromide | 97.7 g |
| | $H_2O$ | 199.2 ml |
| G-112 | | |
| | Alkali-processed inert gelatin (Av. M.W. 100,000) | 84.0 g |
| | Compound A (10 wt. % methanol solution) | 2.3 ml |
| | $H_2O$ | 600 ml |

Formation of Core Phase

Subsequent to formation of the internal phase, aqueous 3.5N silver nitrate solution S-113 and aqueous 3.5N potassium bromide/potassium iodide (10 mol % potassium iodide) solution X-113 were added by the double jet addition at an accelerated flow rate to form a core phase, while the silver potential was kept at 6 mV using a 1N potassium bromide solution.

| | | |
|---|---|---|
| S-113 | | |
| | Silver nitrate | 705.6 g |
| | $H_2O$ | 1024.6 ml |
| X-113 | | |
| | Potassium bromide | 444.9 g |
| | Potassium iodide | 69.0 g |
| | $H_2O$ | 1003.3 ml |

Formation of Intermediate Phase:

Subsequent to formation of the internal phase, aqueous 3.5N silver nitrate solution S-114 and aqueous 3.5N potassium bromide solution X-114 were added by the double jet addition at an accelerated flow rate to form an intermediate phase, while the silver potential was kept at 6 mV using a 1N potassium bromide solution.

| | | |
|---|---|---|
| S-114 | | |
| | Silver nitrate | 768.0 g |
| | $H_2O$ | 1115.2 ml |
| X-114 | | |
| | Potassium bromide | 538.1 g |
| | Potassium iodide | 69.0 g |
| | $H_2O$ | 1096.5 ml |

Formation of High Iodide Phase

After completion of the addition described above, the temperature within the reaction vessel was lowered to 40° C. in 30 min. Subsequently, the silver potential was adjusted to −32 mV using an aqueous 3.5N potassium bromide solution and a silver iodide fine grain emulsion having an average grain size of 0.03 μm was added thereto in an amount of 0.283 mole equivalent to a high iodide containing phase.

Formation of Shell Phase

Subsequent to the addition of a silver iodide fine grain emulsion, aqueous 3.5N silver nitrate solution S-115 and aqueous 3.5N potassium bromide solution X-115 were added at an accelerated flow rate to form a shell phase.

| | | |
|---|---|---|
| S-115 | | |
| | Silver nitrate | 720.0 g |
| | $H_2O$ | 1045.5 ml |
| X-115 | | |
| | Potassium bromide | 504.4 g |
| | $H_2O$ | 1028.0 ml |

In the formation of each phase except for nucleation, an addition of aqueous silver nitrate and halide solutions was conducted at an accelerated flow rate within the range of forming no new nucleus grain. After completing formation of the shell phase, the emulsion was desalted to remove soluble salts according to the method described in JP-A 5-72658. Adding gelatin, the emulsion was dispersed and then adjusted to a pH of 5.8 and a pAg of 8.1 at 40° C. Silver halide tabular rain emulsion A-01 was thus obtained. As a result of analysis, it was proved that emulsion A-01 exhibited an average grain size (cubic equivalent diameter) of 0.85 μm and at least 80% of total grain projected area was accounted for by tabular grains having an aspect ration of 5 or more.

An iodide distribution structure within the grain of emulsion A-01 are shown in Table 1.

TABLE 1

| Internal Phase | | Core Phase | | Intermediate Phase | | High Iodide Phase | | Shell Phase | |
|---|---|---|---|---|---|---|---|---|---|
| Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| 0 | 6.6 | 10 | 29.4 | 0 | 32 | 100 | 2 | 0 | 30 |

*Percentage based on silver.

Preparation of Emulsions A-02 and A-03

Emulsion A-02 and A-03 were each prepared in a manner similar to emulsion A-01, except that amounts of added solutions and halide composition were varied so that an iodide distribution, as shown in Table 2 was formed within the grain.

TABLE 2

| Emulsion | Internal Phase | | Core Phase | | Intermediate Phase | | High Iodide Phase | | Shell Phase | |
|---|---|---|---|---|---|---|---|---|---|---|
| | Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| A-02 (Comp.) | 0 | 21.6 | 20 | 29.4 | 0 | 32 | 100 | 2 | 0 | 30 |
| A-03 (Comp.) | 0 | 6.6 | 5 | 61.4 | — | — | 100 | 2 | 0 | 30 |

*Percentage based on silver.

Preparation of Emulsion A-04 (Inventive Example)

Formation of Internal Phase

After nucleation was conducted in a manner similar to emulsion A-01, an internal phase was formed in the following manner.

Growth stage:

3.5N aqueous silver nitrate solutions S-412 and 3.5N aqueous potassium bromide solution X-412 were added by the double jet addition at an accelerated flow rate (12 times faster at the end than at the start) for 38 min, while the silver potential was maintained at 6 mV with 1N potassium bromide solution. After completing the addition was added solution G-412.

| | | | |
|---|---|---|---|
| S-412 | | | |
| | Silver nitrate | 809.2 | g |
| | $H_2O$ | 1175.0 | ml |
| X-412 | | | |
| | Potassium bromide | 97.7 | g |
| | $H_2O$ | 1155.3 | ml |
| G-112 | | | |
| | Alkali-processed inert gelatin (Av. M.W. 100,000) | 84.0 | g |
| | Compound A (10 wt. % methanol solution) | 2.3 | ml |
| | $H_2O$ | 600 | ml |

Formation of First High Iodide Phase

After completion of the addition described above, a silver iodide fine grain emulsion of an average grain size of 0.03 $\mu$m was added thereto in an amount of 0.212 mole equivalent to form a first high iodide phase.

After forming the first high iodide phase, the formation of an intermediate phase and the consecutive steps were conducted in a manner similar to emulsion A-01 to obtain tabular grain emulsion A-04. As a result of analysis, it was proved that emulsion A-04 exhibited an average grain size (cubic equivalent diameter) of 0.85 $\mu$m and at least 80% of total grain projected area was accounted for by tabular grains having an aspect ration of 5 or more.

An iodide distribution structure within the grain of emulsion A-04 are shown in Table 3.

TABLE 3

| Internal Phase | | Core Phase | | Intermediate Phase | | High Iodide Phase | | Shell Phase | |
|---|---|---|---|---|---|---|---|---|---|
| Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| 0 | 34.5 | 100 | 1.5 | 0 | 32 | 100 | 2 | 0 | 30 |

*Percentage based on silver.

Preparation of Emulsions A-05 to A-09

Emulsion A-05 to A-09 were each prepared in a manner similar to emulsion A-04, except that amounts of added solutions and halide composition were varied so that an iodide distribution, as shown in Table 4 was formed within the grain. It was proved that in each of emulsions A-05 to A-09, at least 80% of total grain projected area was accounted for by tabular grains having an aspect ratio of 5 or more.

TABLE 4

| | Internal Phase | | First High iodide Phase | | Intermediate Phase | | Second High Iodide Phase | | Shell Phase | |
|---|---|---|---|---|---|---|---|---|---|---|
| Emulsion | Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| A-05 (Comp.) | 0 | 64.5 | 100 | 1.5 | — | — | 100 | 2 | 0 | 30 |
| A-06 (Inv.) | 0 | 34.5 | 100 | 0.5 | 0 | 32 | 100 | 2 | 0 | 30 |
| A-07 (Inv.) | 0 | 33 | 100 | 3 | 0 | 32 | 100 | 2 | 0 | 30 |
| A-08 (Inv.) | 0 | 31.5 | 100 | 4.5 | 0 | 32 | 100 | 2 | 0 | 30 |
| A-09 (Comp.) | 0 | 30.5 | 100 | 5.5 | 0 | 32 | 100 | 2 | 0 | 30 |

*Percentage based on silver.

The thus obtained emulsions were each determined with respect to a variation coefficient of grain thickness and a variation coefficient of grain diameter according to the afore-mentioned method. Results thereof are shown in Table 5.

Further, dislocation lines of 20 or more per grain were observed in each of the emulsions. Specifically in emulsions A-04 and A-07, dislocation lines were observed even inside the second high iodide phase.

TABLE 5

| Emulsion | | Variation Coefficient of Grain Thickness | Variation Coefficient of Grain diameter |
|---|---|---|---|
| A-01 | (Comp.) | 31% | 24% |
| A-02 | (Comp.) | 38% | 29% |
| A-03 | (Comp.) | 28% | 18% |
| A-04 | (Inv.) | 21% | 16% |
| A-05 | (Comp.) | 24% | 21% |
| A-06 | (Inv.) | 19% | 15% |
| A-07 | (Inv.) | 24% | 19% |
| A-08 | (Inv.) | 27% | 20% |
| A-09 | (Comp.) | 30% | 25% |

To each of emulsions A-01 to A-09 maintained at 52° C. were added sensitizing dyes SD-6, SD-7 and SD-8. After ripening for 20 min. were added sodium thiosulfate, triphenylphosphineselenide, chloroauric acid and potassium thiocyanate. Amounts of sensitizing dyes and sensitizers were adjusted to achieve an optimum sensitivity-fog relationship for each emulsion, and after completion of sensitization, 1-phenyl-5-mercaptotetrazole and 4-hydroxy-1,3,3a,7-tetrazaindene were added to each emulsion.

Preparation of Color Photographic Material

On a triacetyl cellulose film support were formed the following layers containing composition as shown below to prepare a multi-layered color photographic material Sample A01. In this case, spectrally and chemically sensitized emulsion A-01 was used in the 10th layer of the color photographic material. The addition amount of each compound was represented in term of g/m$^2$, provided that the amount of silver halide or colloidal silver was converted to the silver amount and the amount of a sensitizing dye was represented in mol/Ag mol.

| | |
|---|---|
| 1st Layer: Anti-Halation Layer | |
| Black colloidal silver | 0.16 |
| UV absorbent (UV-1) | 0.3 |
| Colored magenta coupler (CM-1) | 0.123 |
| Colored cyan coupler (CC-1) | 0.044 |
| High boiling solvent (OIL-1) | 0.167 |
| Gelatin | 1.33 |
| 2nd Layer: Intermediate Layer | |
| Anti-staining agent (AS-1) | 0.16 |
| High boiling solvent (OIL-1) | 0.20 |
| Gelatin | 0.69 |
| 3rd Layer: Low-speed Red-Sensitive Layer | |
| Silver iodobromide emulsion a | 0.20 |
| Silver iodobromide emulsion b | 0.29 |
| Sensitizing dye (SD-1) | $2.37 \times 10^{-5}$ |
| Sensitizing dye (SD-2) | $1.2 \times 10^{-4}$ |
| Sensitizing dye (SD-3) | $2.4 \times 10^{-4}$ |
| Sensitizing dye (SD-4) | $2.4 \times 10^{-6}$ |
| Cyan coupler (C-1) | 0.32 |
| Colored cyan coupler (CC-1) | 0.038 |
| Highboiling solvent (OIL-2) | 0.28 |
| Anti-staining agent (AS-2) | 0.002 |
| Gelatin | 0.73 |
| 4th Layer: Medium-speed Red-sensitive Layer | |
| Silver iodobromide emulsion c | 0.10 |
| Silver iodobromide emulsion d | 0.86 |
| Sensitizing dye (SD-1) | $4.5 \times 10^{-5}$ |
| Sensitizing dye (SD-2) | $2.3 \times 10^{-4}$ |
| Sensitizing dye (SD-3) | $4.5 \times 10^{-4}$ |
| Cyan coupler (C-2) | 0.52 |
| Colored cyan coupler (CC-1) | 0.06 |
| DIR compound (DI-1) | 0.047 |
| High boiling solvent (OIL-2) | 0.46 |
| Anti-staining agent (AS-2) | 0.004 |
| Gelatin | 1.30 |

-continued

| | |
|---|---|
| 5th Layer: High-speed Red-Sensitive Layer | |
| Silver iodobromide emulsion c | 0.13 |
| Silver iodobromide emulsion d | 1.18 |
| Sensitizing dye (SD-1) | $3.0 \times 10^{-5}$ |
| Sensitizing dye (SD-2) | $1.5 \times 10^{-4}$ |
| Sensitizing dye (SD-3) | $3.0 \times 10^{-4}$ |
| Cyan coupler (C-2) | 0.047 |
| Cyan coupler (C-3) | 0.09 |
| Colored cyan coupler (CC-1) | 0.036 |
| DIR compound (DI-1) | 0.024 |
| High boiling solvent (OIL-2) | 0.27 |
| Anti-staining agent (AS-2) | 0.006 |
| Gelatin | 1.28 |
| 6th Layer: Intermediate Layer | |
| High boiling solvent (OIL-1) | 0.29 |
| Anti-staining agent (AS-1) | 0.23 |
| Gelatin | 1.00 |
| 7th Layer: Low-speed Green-Sensitive Layer | |
| Silver iodobromide emulsion a | 0.19 |
| Silver iodobromide emulsion b | 0.062 |
| Sensitizing dye (SD-4) | $3.6 \times 10^{-4}$ |
| Sensitizing dye (SD-5) | $3.6 \times 10^{-4}$ |
| Magenta coupler (M-1) | 0.18 |
| Colored magenta coupler (CM-1) | 0.033 |
| High boiling solvent (IL-1) | 0.22 |
| Anti-staining agent (AS-2) | 0.002 |
| Anti-staining agent (AS-3) | 0.05 |
| Gelatin | 0.61 |
| 8th layer: Interlayer | |
| High boiling solvent (OIL-1) | 0.26 |
| Anti-staining agent (AS-1) | 0.054 |
| Gelatin | 0.80 |
| 9th Layer: Medium-speed Green-Sensitive Layer | |
| Silver iodobromide emulsion e | 0.54 |
| Silver iodobromide emulsion f | 0.54 |
| Sensitizing dye (SD-6) | $3.7 \times 10^{-4}$ |
| Sensitizing dye (SD-7) | $7.4 \times 10^{-5}$ |
| Sensitizing dye (SD-8) | $5.0 \times 10^{-5}$ |
| Magenta coupler (M-1) | 0.17 |
| Magenta coupler (M-2) | 0.33 |
| Colored cyan couple (CM-1) | 0.024 |
| Colored magenta coupler (CM-2) | 0.029 |
| DIR compound (DI-2) | 0.024 |
| DIR compound (DI-3) | 0.005 |
| High boiling solvent (OIL-1) | 0.73 |
| Anti-staining agent (AS-2) | 0.003 |
| Anti-staining agent (AS-3) | 0.035 |
| Gelatin | 1.80 |
| 10th Layer: High-speed Green-Sensitive Layer | |
| Emulsion A-01 | 1.19 |
| Sensitizing dye (SD-6) | $4.0 \times 10^{-4}$ |
| Sensitizing dye (SD-7) | $8.0 \times 10^{-5}$ |
| Sensitizing dye (SD-8) | $5.0 \times 10^{-5}$ |
| Magenta coupler (M-1) | 0.065 |
| Colored magenta coupler (CM-1) | 0.022 |
| Colored magenta coupler (CM-2) | 0.026 |
| DIR compound (DI-2) | 0.003 |
| DIR compound (DI-3) | 0.003 |
| High boiling solvent (OIL-1) | 0.19 |
| High boiling solvent (OIL-2) | 0.43 |
| Anti-staining agent (AS-2) | 0.014 |
| Anti-staining agent (AS-3) | 0.017 |
| Gelatin | 1.23 |
| 11th Layer: Yellow Filter Layer | |
| Yellow colloidal silver | 0.05 |
| High boiling solvent (OIL-1) | 0.18 |
| Anti-staining agent (AS-1) | 0.16 |
| Gelatin | 1.00 |
| 12th Layer: Low-speed Blue-sensitive Layer | |
| Silver iodobromide emulsion a | 0.08 |
| Silver iodobromide emulsion b | 0.22 |

-continued

| | |
|---|---|
| Silver iodobromide emulsion h | 0.09 |
| Sensitizing dye (SD-9) | $6.5 \times 10^{-4}$ |
| Sensitizing dye (SD-10) | $2.5 \times 10^{-4}$ |
| Yellow coupler (Y-1) | 0.77 |
| DIR compound (DI-4) | 0.017 |
| High boiling solvent (OIL-1) | 0.31 |
| Anti-staining agent (AS-2) | 0.002 |
| Gelatin | 1.29 |
| 13th Layer: High-sped Blue-sensitive Layer | |
| Silver iodobromide emulsion h | 0.41 |
| Silver iodobromide emulsion i | 0.61 |
| Sensitizing dye (SD-9) | $4.4 \times 10^{-4}$ |
| Sensitizing dye (SD-10) | $1.5 \times 10^{-4}$ |
| Yellow coupler (Y-1) | 0.23 |
| High boiling solvent (OIL-1) | 0.10 |
| Anti-staining agent (AS-2) | 0.004 |
| Gelatin | 1.20 |
| 14th Layer: First Protective Layer | |
| Silver iodobromide emulsion j | 0.30 |
| UV absorbent (UV-1) | 0.055 |
| UV absorbent (UV-2) | 0.110 |
| High boiling solvent (OIL-2) | 0.30 |
| Gelatin | 1.32 |
| 15th Layer: Second protective Layer | |
| Polymer PM-1 | 0.15 |
| Polymer PM-2 | 0.04 |
| Lubricant (WAX-1) | 0.02 |
| Dye (D-1) | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size (μm) | Av. AgI content (mol%) | Diameter/thickness ratio |
|---|---|---|---|
| a | 0.30 | 2.0 | 1.0 |
| b | 0.40 | 5.0 | 1.4 |
| c | 0.60 | 5.0 | 3.1 |
| d | 0.74 | 5.0 | 5.0 |
| e | 0.60 | 5.0 | 4.1 |
| f | 0.65 | 5.0 | 6.5 |
| h | 0.65 | 8.0 | 1.4 |
| i | 1.00 | 8.0 | 2.0 |
| j | 0.05 | 2.0 | 1.0 |

Each of the emulsions described above was added with sensitizing dyes afore-described and ripened, and then chemically sensitized by adding triphenylphosphine selenide, sodium thiosulfate, chloroauric acid and potassium thiocyanate until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical formulas of compounds used in the Samples described above are shown below.

SU-1: $C_8F_{17}SO_2N(C_3H_7)CH_2COOK$

SU-2: $C_8F_{17}SO_2NH(CH_2)_3N^+(CH_3)_3Br^-$

Su-3: Sodium di-(2-ethylhexyl) sulfosuccinate

SU-4: Tri-i-propylnaphthalenesulfonic acid sodium salt

ST-1: 4-hydroxy-6-methyl-1,3,3a,7-tetraazaindene

ST-2: Adenine

AF-3: 1-Phenyl-5-mercaptotetrazole

AF-4: 1-(4-Carboxyphenyl)-5-mercaptotetrazole

AF-5: 1-(3-Acetoamidophenyl)-5-mercaptotetrazole

H-1: $[CH_2{=}CHSO_2CH_2)_3CCH_2SO_2CH_2CH_2]_2NCH_2CH_2SO_3K$

H-2: 2,4-Dichloro-6-hydroxy-s-triazine sodium salt

OIL-1: Tricresyl phosphate

OIL-2: Di(2-ethylhexyl)phthalate

AS-1: 2,5-Bis(1,1-dimethyl-4-hexyloxycarbonylbutyl)-hydroquinone

As-2: Dodecyl gallate

AS-3: 1,4-Bis(2-tetradecyloxycarbonylethyl)piperazine

C-1

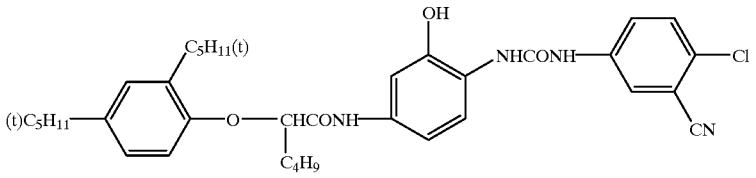

C-2

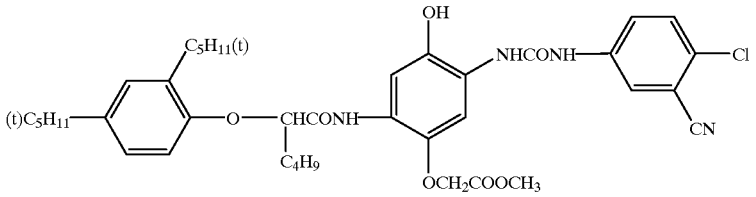

C-3

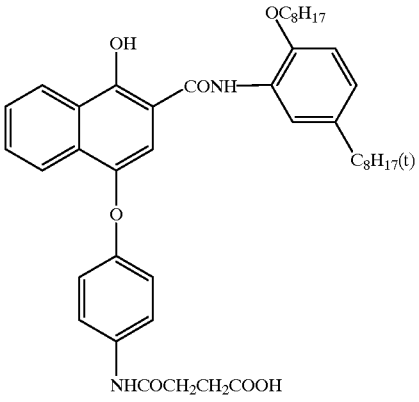

M-1

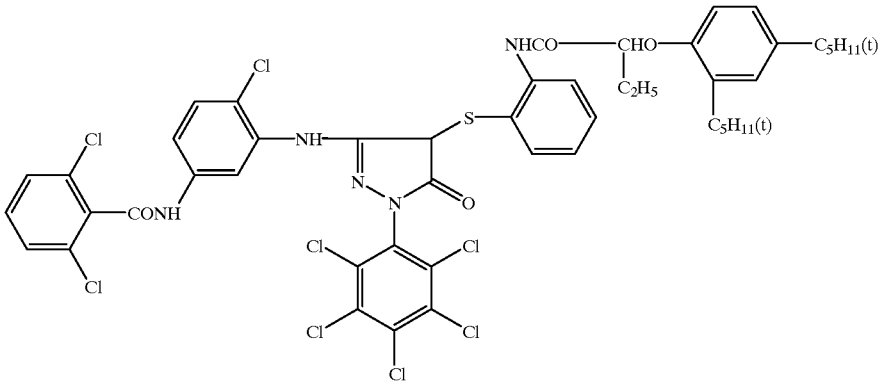

-continued
M-2
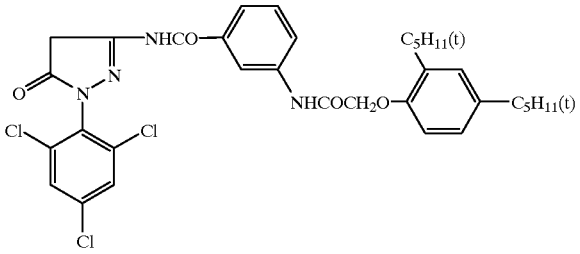
Y-1
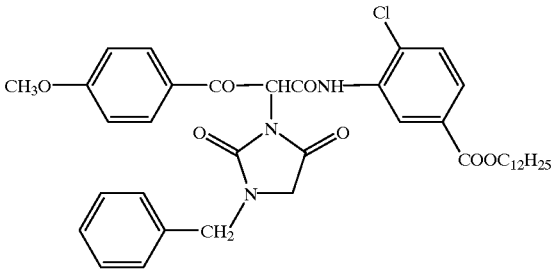
CC-1
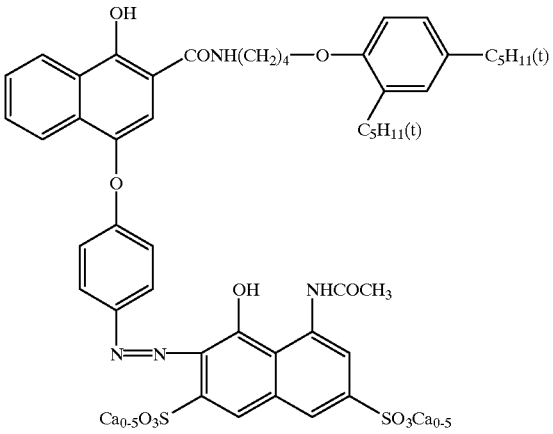
CM-1
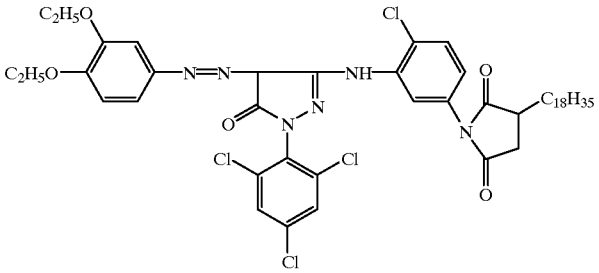
CM-2
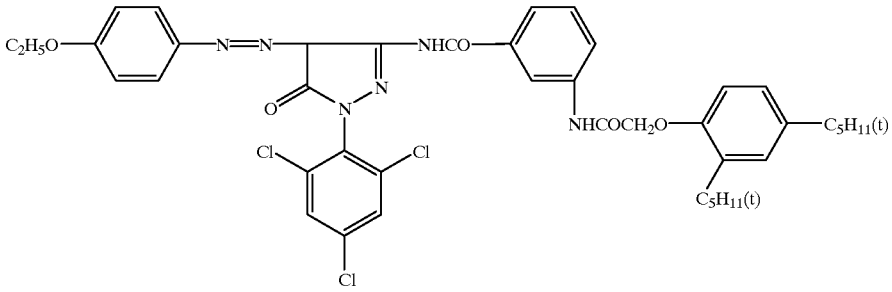
DI-1
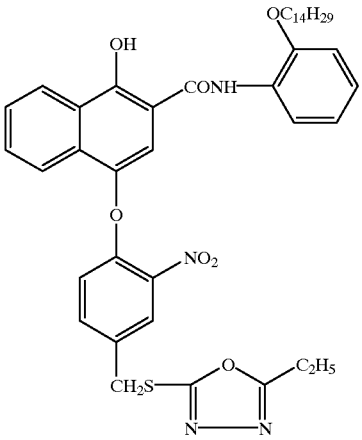
DI-2
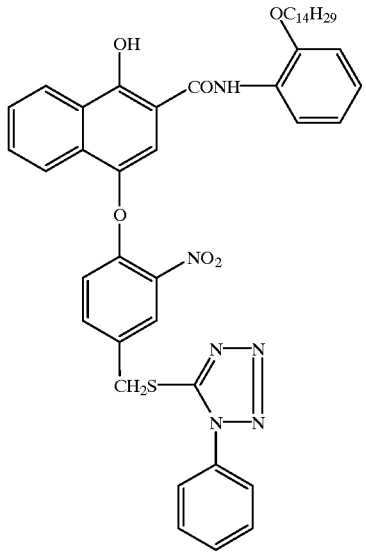

-continued
DI-3
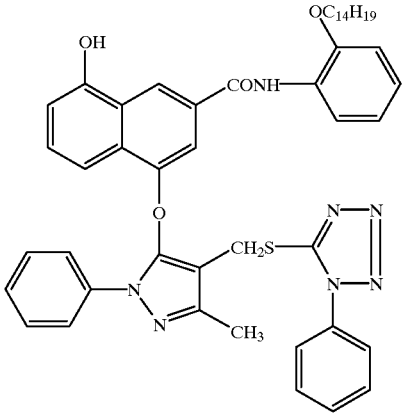
DI-4
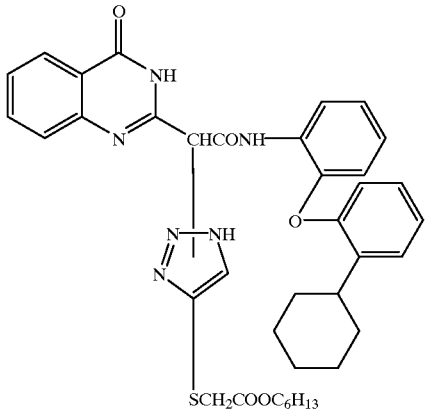
SD-1
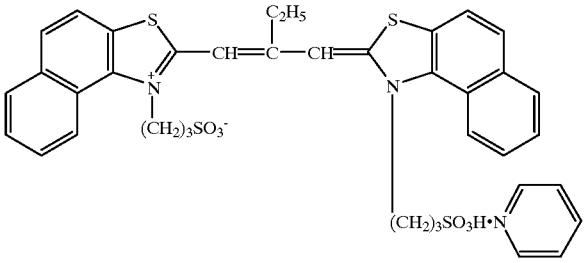
SD-2
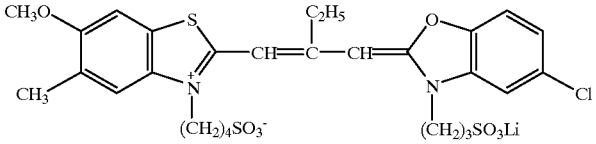
SD-3
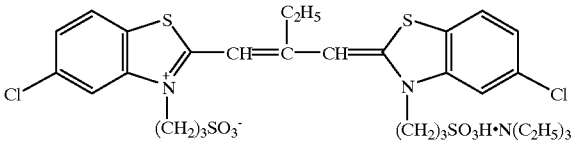
SD-4
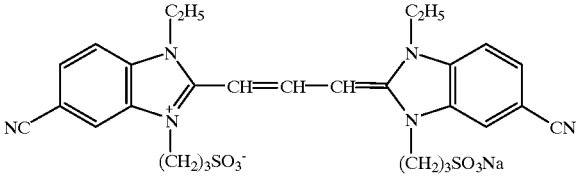
SD-5
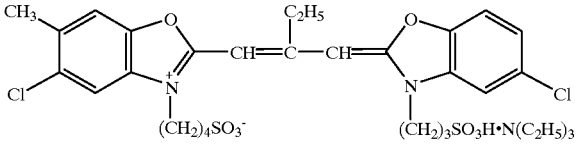
SD-6
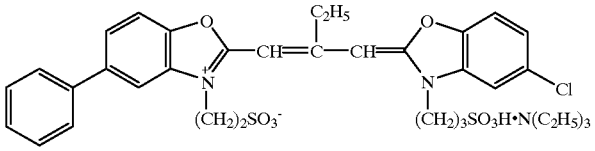
SD-7
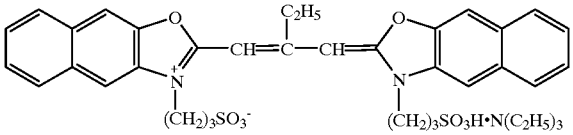
SD-8
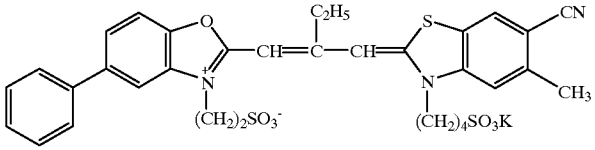
SD-9
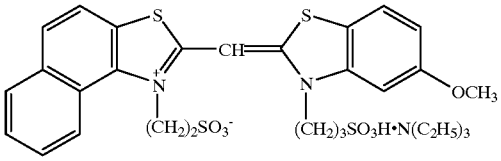
SD-10
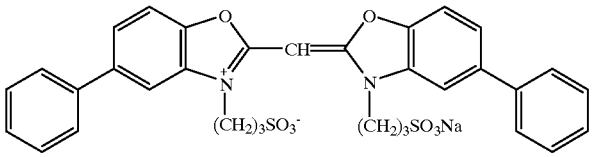

-continued

WAX-1

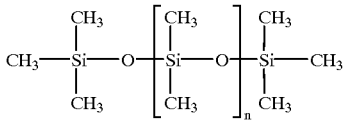

Mw=3,000

D-1

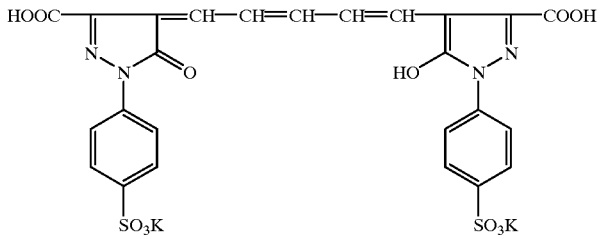

PM-1

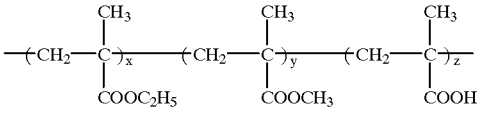

x:y:z=3:3:4

PM-2

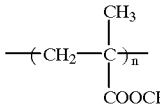

n: Polymerization degree

UV-1

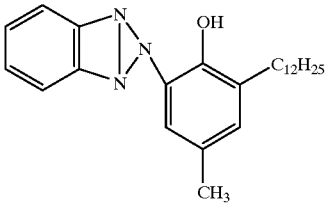

V-1

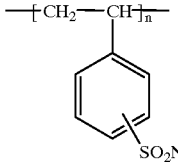

n:Polymerization degree

Ase-1 (Mixture)

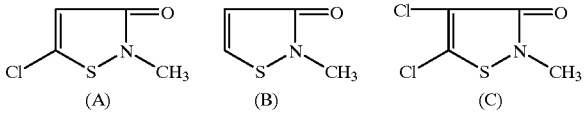

(A) (B) (C)

A:B:C=50:46:4 (molar ratio)

Color photographic material Samples A02 to A09 were prepared similarly to Sample A01, except that emulsion A-01 was replaced by each of emulsions A-02 to A-09. Samples A01 to A09 were each exposed, through an optical wedge, to white light at 1/200 sec. and 3.2 CMS and then processed according to the following procedure.

| Processing: Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*: Amounts per $m^2$ of photographic material

A color developer, bleach, fixer and stabilizer each were prepared according to the following formulas. Color developer (worker solution):

| | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |

-continued

| | |
|---|---|
| Sodium chloride | 0.6 g |
| 4-Amino-3-methyl-N-(?-hydroxyethyl)-aniline sulfate | 4.5 g |
| Diethylenetriaminepentaacetic acid | 3.0 g |
| Potassium hydroxide | 1.2 g |

Water was added to make 1 liter in total, and the pH was adjusted to 10.06, with potassium hydroxide and sulfuric acid.

Color developer (replenisher solution):

| | |
|---|---|
| Water | 800 ml |
| Potassium carbonate | 35 g |
| Sodium hydrogencarbonate | 3.0 g |
| Potassium sulfite | 5.0 g |
| Sodium bromide | 0.4 g |
| Hydroxylamine sulfate | 3.1 g |
| 4-Amino-3-methyl-N-(?-hydroxyethyl)-aniline sulfate | 6.3 g |
| Potassium hydroxide | 2.0 g |
| Diethylenetriaminepentaacetic acid | 3.0 g |

Water was added to make 1 liter in total, and the pH was adjusted to 10.18, with potassium hydroxide and sulfuric acid.

Bleach (worker solution):

| | |
|---|---|
| Water | 700 ml |
| Ammonium iron (III) 113-diamino-propanetetraacetic acid | 125 g |
| Ethylenediaminetetraacetic acid | 2 g |
| Sodium nitrate | 40 g |
| Ammonium bromide | 150 g |
| Glacial acetic acid | 40 g |

Water was added to make 1 liter in total and the pH was adjusted to 4.4, with ammoniacal water or glacial acetic acid.

Bleach (replenisher solution):

| | |
|---|---|
| Water | 700 ml |
| Ammonium iron (III) 1,3-diamino-propanetetraacetic acid | 175 g |
| Ethylenediaminetetraacetic acid | 2 g |
| Sodium nitrate | 50 g |
| Ammonium bromide | 200 g |
| Glacial acetic acid | 56 g |

Water was added to make 1 liter in total and the pH was adjusted to 4.4, with ammoniacal water or glacial acetic acid.

Fixer (worker solution):

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was added to make 1 liter in total and the pH was adjusted to 6.2, with ammoniacal water or glacial acetic acid.

Fixer (replenisher solution):

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Water was added to make 1 liter in total and the pH was adjusted to 6.5, with ammoniacal water or glacial acetic acid.

Stabilizer (worker and replenisher solution):

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Thus-processed color photographic material samples were each measured with respect to sensitivity, fog, a relative RMS value, and pressure resistance, using green light. The relative RMS value was measured with red light. The measurement method and conditions thereof are as follows.

Sensitivity was represented by relative value of reciprocal of exposure giving a density of an unexposed area density (=Dmin) plus 0.1, based on the sensitivity of Sample A01 being 100. The more the value, the higher the sensitivity. Fog was represented by a relative value of a density of unexposed areas, based on the fog of Sample A01 being 100. The less the value, the fog is the more preferred.

The RMS value was measured at a density of Dmin plus 0.2. The RMS value, which was measured by scanning the measuring position of each sample by a microdensitometer (of a 10 $\mu$m slit width and 180 $\mu$m slit length) installed with Wratten filter W-99 (available from Eastman Kodak Corp.), was determined as a standard deviation of densities of density measurement sampling number of 1,000 or more. The RMS value was represented by a relative value, based on the RMS of Sample A01 being 100. The less RMS value, the superior graininess.

Pressure resistance of each sample was evaluated in the following manner. Unexposed samples were each allowed to stand in an atmosphere of 23° C. and 55% R.H. over a period of 24 hrs. Using a scratch resistance tester (produced by SHINTO-KAGAKU Co. Ltd.) in the same atmosphere, a needle of top curvature radius of 0.025 mm was placed on each sample and moved at a constant speed with loading a load of 5 g and samples were immediately exposed and processed according to the manner described above. Density variation of each sample was represented by a value of the difference in density between loaded and unloaded portions, which was measured by a microdensitometer installed with Wratten filter (W-99). The density variation was represented by a relative value, based on that of Sample A01 being 100. The density was measured at the position of a density of Dmin plus 0.2 in unexposed areas. The less value is less density variation with load and superior pressure resistance.

MTF (Modulation Transfer Function) of each sample was evaluated in the following manner. Each sample was exposed through a test pattern used for evaluation of sharpness and processed according the process described above. A MTF value was determined at 20 mm/line of a cyan image and represented by a relative value, based on that of Sample A01 being 100. The higher MTF is superior sharpness.

Evaluation results of samples were shown in Table 6.

TABLE 6

| Sample | | Fog | Sensitivity | RMS | Density Variation | MTF |
|---|---|---|---|---|---|---|
| A01 | (Comp.) | 100 | 100 | 100 | 100 | 100 |
| A02 | (Comp.) | 95 | 105 | 115 | 115 | 80 |
| A03 | (Comp.) | 105 | 80 | 95 | 135 | 105 |
| A04 | (Inv.) | 85 | 125 | 90 | 60 | 115 |
| A05 | (Comp.) | 95 | 85 | 110 | 120 | 95 |
| A06 | (Inv.) | 90 | 110 | 95 | 90 | 120 |
| A07 | (Inv.) | 85 | 130 | 90 | 70 | 110 |
| A08 | (Inv.) | 80 | 115 | 85 | 85 | 110 |
| A09 | (Comp.) | 80 | 105 | 95 | 105 | 105 |

As apparent from the comparison of Sample A01 to A05 shown in Table 6, silver halide emulsion A-04, which contained silver halide grains including two high iodide phases across the intermediate phase, exhibited enhanced sensitivity, superior graininess and improved pressure resistance, compared to emulsions A-01 to A-03, in which silver halide grains did not include two high iodide phases and emulsion A-05 containing silver halide grains including no intermediate phase. Comparing Sample A04 with Samples A06 to A09, it is shown that when the high iodide phase accounted for 1 to 3% of the grain (based on silver), effects of the invention was markedly enhanced and when the high iodide phase accounted for more than 5% of the grain, effects of the invention were not obtained. It was further proved that sample by the use of emulsion A-04 or A-07, in which dislocation lines were observed both inside and outside the second high-iodide phase, exhibited marked improvement effects. Inventive samples also exhibited superior sharpness and specifically, emulsions according to the invention having a variation coefficient of grain thickness of not more than 25% exhibited improved sharpness. As can be seen from the foregoing, the object of the invention was accomplished by silver halide emulsion according to the invention and photographic materials by the use thereof.

Example 2

Preparation of Emulsions B-01 to B-08

Emulsion B-01 and B-08 were each prepared in a manner similar to emulsion A-04 of Example 1, except that amounts of added solutions and halide composition were varied so that an iodide distribution, as shown in Table 7, was formed within the grain.

TABLE 7

| | Internal Phase | | First High iodide Phase | | Intermediate Phase | | Second High Iodide Phase | | Shell Phase | |
|---|---|---|---|---|---|---|---|---|---|---|
| Emulsion | Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| B-01 (Inv.) | 0 | 34.5 | 100 | 1.5 | 2 | 32 | 100 | 2 | 0 | 30 |
| B-02 (Inv.) | 0 | 34.5 | 100 | 1.5 | 5 | 32 | 100 | 2 | 0 | 30 |
| B-03 (Inv.) | 0 | 34.5 | 100 | 1.5 | 8 | 32 | 100 | 2 | 0 | 30 |
| B-04 (Comp.) | 0 | 34.5 | 100 | 1.5 | 12 | 32 | 100 | 2 | 0 | 30 |
| B-05 (Comp.) | 0 | 61.5 | 100 | 1.5 | 2 | 5 | 100 | 2 | 0 | 30 |
| B-06 (Inv.) | 0 | 51.5 | 100 | 1.5 | 2 | 15 | 100 | 2 | 0 | 30 |
| B-07 (Inv.) | 0 | 16.5 | 100 | 1.5 | 2 | 50 | 100 | 2 | 0 | 30 |
| B-08 (Comp.) | 0 | 6.6 | 100 | 1.5 | 2 | 75 | 100 | 2 | 0 | 14.9 |

*Percentage based on silver.

The thus obtained emulsions, B-01 to B-08 were each subjected to sensitization treatments. Coupler M-2 was dissolved in tricresyl phosphate and dispersed in an aqueous gelatin solution and was added to each of the emulsions, together with a coating aid and hardeners to prepare a coating solution. The coating solution was coated on a subbed triacetate film support and dried to obtain green-sensitive photographic material samples B01 to B08. Using emulsions A-01 and A-04, green-sensitive photographic material samples A01G and A04G were similarly prepared. Fresh samples were exposed, through glass filter Y-48 (available from TOSHIBA Corp.), to white light of 3.2 CMS for 1/200 sec. and processed similarly to Example 1. Further, samples were prepared to make evaluation with respect to pressure resistance and subjected to exposure and processing similarly to Example 1.

The thus processed samples were measured using green light with respect to sensitivity, fog, RMS and density variation similarly to Example 1. Results thereof are shown in Table 8, in which each value is represented by a relative value, based on Sample A01G.

TABLE 8

| Sample | | Fog | Sensitivity | RMS | Density Variation |
|---|---|---|---|---|---|
| A01G | (Comp.) | 100 | 100 | 100 | 100 |
| A04G | (Inv.) | 85 | 125 | 90 | 60 |
| B01 | (Inv.) | 80 | 130 | 80 | 60 |
| B02 | (Inv.) | 80 | 120 | 75 | 65 |
| B03 | (Inv.) | 75 | 115 | 70 | 80 |
| B04 | (Comp.) | 80 | 90 | 95 | 110 |
| B05 | (Comp.) | 95 | 90 | 100 | 115 |
| B06 | (Inv.) | 85 | 120 | 90 | 85 |
| B07 | (Inv.) | 80 | 125 | 85 | 55 |
| B08 | (Comp.) | 85 | 90 | 90 | 100 |

As can be seen from Table 8, it was proved that the intermediate phase accounting for 10 to 70% of the grain and having an average iodide content of 0 to 10 mol % led to superior effects. Further, as can be seen from comparison of B-01 to B-05 to B-08, the intermediate phase accounting for 15 to 50% of the grain led to specifically superior effects. Similarly from comparison of A-04 to B-01 to B-04, the average iodide content of 0 to 5 mol % led to specifically superior effects.

Example 3

Preparation of Emulsions C-01 to C-08

Emulsion C-01 and C-08 were each prepared in a manner similar to emulsion A-04 of Example 1, except that amounts of added solutions and halide composition were varied so that an iodide distribution, as shown in Table 9, was formed within the grain.

TABLE 9

| | Internal Phase | | First High iodide Phase | | Intermediate Phase | | Second High Iodide Phase | | Shell Phase | |
|---|---|---|---|---|---|---|---|---|---|---|
| Emulsion | Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| C-01 (Inv.) | 0 | 34.5 | 100 | 1.5 | 2 | 32 | 100 | 2 | 1 | 30 |
| C-02 (Inv.) | 0 | 34.5 | 100 | 1.5 | 2 | 32 | 100 | 2 | 4 | 30 |
| C-03 (Inv.) | 0 | 34.5 | 100 | 1.5 | 2 | 32 | 100 | 2 | 8 | 30 |
| C-04 (Inv.) | 0 | 34.5 | 100 | 1.5 | 2 | 32 | 100 | 2 | 12 | 30 |
| C-05 (Comp.) | 0 | 59.5 | 100 | 1.5 | 2 | 32 | 100 | 2 | 1 | 5 |
| C-06 (Inv.) | 0 | 49.5 | 100 | 1.5 | 2 | 32 | 100 | 2 | 1 | 15 |
| C-07 (Inv.) | 0 | 19.5 | 100 | 1.5 | 2 | 32 | 100 | 2 | 1 | 45 |
| C-08 (Comp.) | 0 | 6 | 100 | 1.5 | 2 | 32 | 100 | 2 | 1 | 60 |

*Percentage based on silver.

The thus obtained emulsions, C-01 to C-08 were each subjected to sensitization treatments. Coupler M-2 was dissolved in tricresyl phosphate and dispersed in an aqueous gelatin solution and was added to each of the emulsions, together with a coating aid and hardeners to prepare a coating solution. The coating solution was coated on a subbed triacetate film support and dried to obtain green-sensitive photographic material samples C01 to C08. Fresh samples were exposed, through glass filter Y-48 (available from TOSHIBA Corp.), to white light of 3.2 CMS for 1/200 sec. and processed similarly to Example 1. Further, samples were prepared to make evaluation with respect to pressure resistance and subjected to exposure and processing similarly to Example 1.

The thus processed samples were measured using green light with respect to sensitivity, fog, RMS and density variation similarly to Example 1. Results thereof are shown in Table 10, in which each value is represented by a relative value, based on Sample A01G.

TABLE 10

| Sample | | Fog | Sensitivity | RHS | Density Variation |
|---|---|---|---|---|---|
| A01G | (Comp.) | 100 | 100 | 100 | 100 |
| B01 | (Inv.) | 80 | 130 | 80 | 60 |
| C01 | (Inv.) | 75 | 135 | 70 | 60 |
| C02 | (Inv.) | 70 | 130 | 65 | 65 |
| C03 | (Inv.) | 80 | 115 | 65 | 70 |
| C04 | (Comp.) | 95 | 85 | 95 | 115 |
| C05 | (Comp.) | 85 | 75 | 105 | 115 |
| C06 | (Inv.) | 80 | 110 | 75 | 75 |

TABLE 10-continued

| Sample | | Fog | Sensitivity | RHS | Density Variation |
|---|---|---|---|---|---|
| C07 | (Inv.) | 90 | 120 | 85 | 70 |
| C08 | (Comp.) | 105 | 110 | 115 | 105 |

As can be seen from Table 8, it was proved that the shell phase accounting for 10 to 50% of the grain and having an average iodide content of 0 to 10 mol % led to superior effects of the invention. Further, as can be seen from comparison of C-01 to C-05 to C-08, the shell phase accounting for 20 to 40% of the grain led to specifically superior effects of the invention. Similarly from comparison of B-01 to C-01 to C-04, the average iodide content of 0 to 6 mol % led to specifically superior effects.

Example 4

Preparation of Emulsions D-01 to D-03

Emulsion D-01, D-03 and E-01 to E-04 were each prepared in a manner similar to emulsion A-04 of Example 1, except that amounts of added solutions and halide composition were varied so that an iodide distribution, as shown in Table 11, was formed within the grain. From analysis after the emulsion making, it was proved that silver halide grains of each of emulsions E-01 to E-04 included dislocation lines the inside the second high iodide phase, but outside the second high iodide phase were observed no dislocation line in emulsion E-01 and less than 10 dislocation lines in emulsion E-02.

TABLE 11

| | Internal Phase | | First High iodide Phase | | Intermediate Phase | | Second High Iodide Phase | | Shell Phase | |
|---|---|---|---|---|---|---|---|---|---|---|
| Emulsion | Av. Iodide Content (mol %) | Percentage* | Av. Iodide Content (mol %) | Percentage* | Av. Iodide Content (mol %) | Percentage* | Av. Iodide Content (mol %) | Percentage* | Av. Iodide Content (mol %) | Percentage* |
| D-01 (Inv.) | 1.6 | 34.5 | 100 | 1.5 | 2 | 32 | 100 | 2 | 1 | 30 |
| D-02 (Inv.) | 8.1 | 34.5 | 100 | 1.5 | 2 | 32 | 100 | 2 | 1 | 30 |
| D-03 (Comp.) | 12.1 | 34.5 | 100 | 1.5 | 2 | 32 | 100 | 2 | 1 | 30 |
| E-01 (Inv.) | 1.6 | 34.5 | 100 | 1.5 | 2 | 32 | 100 | 0.5 | 1 | 30 |
| E-02 (Inv.) | 1.6 | 34.5 | 100 | 1.5 | 2 | 32 | 100 | 1 | 1 | 30 |
| E-03 (Inv.) | 1.6 | 34.5 | 100 | 1.5 | 2 | 32 | 100 | 4.5 | 1 | 30 |
| E-04 (Inv.) | 1.6 | 34.5 | 100 | 1.5 | 2 | 32 | 100 | 5.5 | 1 | 30 |

*Percentage based on silver.

The thus obtained emulsions, D-01 to D-03 and E01 to E-04 were each subjected to sensitization treatments. Coupler M-2 was dissolved in tricresyl phosphate and dispersed in an aqueous gelatin solution and was added to each of the emulsions, together with a coating aid and hardeners to prepare a coating solution. The coating solutions were each coated on a subbed triacetate film support and dried to obtain green-sensitive photographic material samples D01 to D03 and E01 to E04. Fresh samples were exposed, through glass filter Y-48 (available from TOSHIBA Corp.), to white light of 3.2 CMS for 1/200 sec. and processed similarly to Example 1. Further, samples were prepared to make evaluation with respect to pressure resistance and subjected to exposure and processing similarly to Example 1.

The thus processed samples were measured using green light with respect to sensitivity, fog, RMS and density variation similarly to Example 1. Results thereof are shown in Table 12, in which each value is represented by a relative value, based on Sample A01G.

TABLE 12

| Sample | | Fog | Sensitivity | RMS | Density Variation |
|---|---|---|---|---|---|
| A01G | (Comp.) | 100 | 100 | 100 | 100 |
| C01 | (Inv.) | 75 | 135 | 70 | 60 |
| D01 | (Inv.) | 75 | 135 | 65 | 60 |
| D02 | (Inv.) | 75 | 115 | 70 | 80 |
| D03 | (Comp.) | 85 | 95 | 85 | 115 |
| E01 | (Inv.) | 80 | 125 | 80 | 65 |
| E02 | (Inv.) | 80 | 130 | 75 | 70 |
| E03 | (Inv.) | 85 | 120 | 75 | 85 |
| E04 | (Inv.) | 85 | 90 | 95 | 110 |

As can be seen from comparison of C-01 to D-01 to D-03, the internal phase having an average iodide content of 0 to 10 mol % led to superior effects of the invention. Specifically, the average iodide content of 0 to 6 mol % led to marked superior effects of the invention. Similarly from comparison of C-01 to E-01 to E-04, it was proved that the second high iodide phase accounting for not more than 3% of the grain (based on silver) led to improved effects of the invention and in the case of 5% or more, no effect of the invention was obtained. The E-01, in which the second high iodide phase accounted for 0.5% of the grain (based on silver) and dislocation lines were observed inside the second high iodide phase, led to desired effects of the invention.

What is claimed is:

1. A silver halide emulsion comprising silver halide grains and a dispersing medium, wherein said silver halide grains, each comprise a first high-iodide phase and a second high-iodide phase, said first and second high-iodide phases each accounting for 0.5 to 5% of the grain, based on silver, and said first and second high-iodide phases each having an average iodide content of more than 40 mol %.

2. The silver halide emulsion of claim 1, wherein said silver halide grains each further comprise an intermediate phase located between the first high-iodide phase and the second high-iodide phase, said intermediate phase having an iodide content of 0 to 10 mol %.

3. The silver halide emulsion of claim 2, wherein said intermediate phase has an average iodide content of 0 to 10 mol %.

4. The silver halide emulsion of claim 3, wherein at least one of the first and second high-iodide phases accounts for 1 to 4% of the grain, based on silver.

5. The silver halide emulsion of claim 3, wherein said intermediate phase accounts for 15 to 50% of the grain, based on silver.

6. The silver halide emulsion of claim 3, wherein said silver halide grains each further comprise an internal phase which is internal to said first and second high-iodide phases, said internal phase accounting for 5 to 60% based on silver of the grain, and having an average iodide content of 0 to 10 mol %.

7. The silver halide emulsion of claim 6, wherein said internal phase has an iodide content of 0 to 10 mol %.

8. The silver halide emulsion of claim 7, wherein said silver halide grains each further comprise a shell phase which is external to said first and second high-iodide phases, said shell phase accounting for 10 to 50% of the grain, based on silver.

9. The silver halide emulsion of claim 1 wherein said first and second high-iodide phase each have an iodide content of more than 40 mol %.

10. The silver halide emulsion of claim 3 wherein said intermediate phase accounts for 10 to 70% of the grain, based on silver.

11. The silver halide emulsion of claim 10 wherein said silver halide grains each further comprise an internal phase which is internal to said first and second high-iodide phases, said internal phase accounting for 5 to 60%, based on silver of the grain, and having an average iodide content of 0 to 10 mol %.

12. The silver halide emulsion of claim 11 wherein said internal phase has an iodide content of 0 to 10 mol %.

13. The silver halide emulsion of claim 12 wherein said silver halide grains each further comprise a shell phase which is external to said first and second high-iodide phases, said shell phase accounting for 10 to 50 of the grain, based on silver.

14. The silver halide emulsion of claim 13 wherein the shell phase has an iodide content of 0 to 10 mol %.

15. The silver halide emulsion of claim 14 wherein said shell phase has an iodide content of 0 to 10 mol %.

16. The silver halide emulsion of claim 15 wherein said intermediate phase accounts for 15 to 50% of the grain, based on silver.

17. The silver halide emulsion of claim 15 wherein said silver halide grains each further comprise dislocation lines located inside either of the first or second high-iodine phase.

18. The silver halide emulsion of claim 15 wherein said silver halide grains each comprise dislocation lines located inside and outside of either of the first or second high-iodine phase.

19. The silver halide emulsion of claim 15 wherein said silver halide grains each comprise dislocation line located in said intermediate phase.

20. The silver halide emulsion of claim 1 wherein each of said silver halide grains comprises, outwardly from the interior of the grain, an internal phase accounting for 5 to 60% of the grain, based on the silver, and having an average iodide content of 0 to 10 mol %;

a first high-iodide phase accounting for 0.5 to 5.0% of the grain, based on the silver, and having an average iodide content of more than 40 mol %;

an intermediate phase accounting for 10 to 70 mol %; of the grain, based on the silver, and having an average iodide content of 0 to 10 mol %;

a second high-iodide phase accounting for 0.5 to 5% of the grain, based on silver, and having an average iodide content of more than 40 mol %; and a shell phase accounting for 10 to 50% of the grain, based on silver, and having an average iodide content of 0 to 10 mol %.

* * * * *